US011548048B1

(12) United States Patent
Starks, Jr. et al.

(10) Patent No.: US 11,548,048 B1
(45) Date of Patent: Jan. 10, 2023

(54) FOLDING SHEET METAL PANELS

(71) Applicant: Building Research Systems, Inc., Edmond, OK (US)

(72) Inventors: Richard G. Starks, Jr., Oklahoma City, OK (US); Ralph L. Herren, Newcastle, OK (US); Robert Lytle, Olive Branch, MS (US)

(73) Assignee: Building Research Systems, Inc.

( * ) Notice: Subject to any disclaimer, the term of this patent is extended or adjusted under 35 U.S.C. 154(b) by 98 days.

(21) Appl. No.: 16/059,846

(22) Filed: Aug. 9, 2018

Related U.S. Application Data

(60) Provisional application No. 62/542,913, filed on Aug. 9, 2017.

(51) Int. Cl.

| | |
|---|---|
| ***B21D 5/08*** | (2006.01) |
| ***E04D 3/30*** | (2006.01) |
| ***B21D 5/02*** | (2006.01) |
| ***B21D 39/02*** | (2006.01) |

(52) U.S. Cl.
CPC ..... *B21D 5/08* (2013.01); *B21D 5/0209* (2013.01); *B21D 39/023* (2013.01); *E04D 3/30* (2013.01)

(58) Field of Classification Search
CPC ... B21D 5/08; B21D 5/12; B21D 7/08; B21D 13/04; B21D 39/02; B21D 39/021; B21D 39/023; B21D 39/025; B21D 19/02; B21D 19/04; B21D 19/043; B21D 5/14; B21D 5/16; E04D 3/30; E04D 3/36; E04D 3/361; E04D 3/364
See application file for complete search history.

(56) References Cited

U.S. PATENT DOCUMENTS

| | | | | |
|---|---|---|---|---|
| 2,171,297 A * | 8/1939 | Zahner | E04D 15/04 | 29/243.5 |
| 3,120,828 A * | 2/1964 | Gronlund | B21D 39/02 | 29/243.57 |
| 3,610,191 A * | 10/1971 | Harris, Jr. | E04D 3/36 | 29/243.5 |
| 3,662,699 A * | 5/1972 | Horn | B21D 39/02 | 29/243.5 |
| 4,027,611 A * | 6/1977 | Ward | B21D 39/02 | 29/243.5 |

(Continued)

OTHER PUBLICATIONS

Jonathan Rider, AEP-Span MultiLok-24 Roof Seamer, https://www.youtube.com/watch?v=XcqiN930A-I (Year: 2013).*

*Primary Examiner* — Jessica Cahill
*Assistant Examiner* — Bobby Yeonjin Kim
(74) *Attorney, Agent, or Firm* — Hall Estill Law Firm

(57) ABSTRACT

Apparatus and associated methodology contemplating a portable sheet metal folding apparatus that folds a sheet metal panel profile into a different predetermined shape, the profile having straight elements joined together by arcs. The apparatus has consecutive roller die sets configured to perform a series of folds on a first element of the profile toward a second element of the profile. Each roller die set has opposing roller dies operably contacting only the first and second elements, not contacting any arc. The opposing roller dies are arranged to define a minimal gap between them equal to or more than the radius of the arc joining the first and second elements together. The gap provides a material relief space that is sized to clearingly permit the arc to positionally shift during folding to relieve stress and strain.

10 Claims, 28 Drawing Sheets

(56) References Cited

U.S. PATENT DOCUMENTS

| | | | | |
|---|---|---|---|---|
| 4,279,211 | A * | 7/1981 | Stellrecht | B21D 39/02 29/402.19 |
| 4,372,022 | A * | 2/1983 | Puckett | B21D 39/02 29/243.58 |
| 4,726,107 | A * | 2/1988 | Knudson | B21D 39/02 29/243.5 |
| 4,918,797 | A * | 4/1990 | Watkins | B21D 39/02 29/243.5 |
| 8,082,649 | B2 * | 12/2011 | Rider | E04D 3/364 29/509 |
| 8,307,526 | B2 * | 11/2012 | Jang | B21D 39/021 29/243.58 |
| 2006/0000255 | A1 * | 1/2006 | Baulier | B21D 39/021 72/306 |
| 2010/0071297 | A1 * | 3/2010 | Meyer | E04D 3/364 52/588.1 |

* cited by examiner

FOLDING SHEET METAL PANELS

RELATED APPLICATION

This application claims the benefit of the earlier filing date of U.S. provisional patent application Ser. No. 62/542,913 filed on Aug. 9, 2017 which is incorporated herein by reference in its entirety.

FIELD OF THE INVENTION

The embodiments of this technology pertain to joining sheet metal panels together, and more particularly but not by way of limitation, to folding overlapping sheet metal panels into a standing seam.

BACKGROUND

Numerous types of structural webs are made in the construction industry by joining sheet metal panels together. Roof assemblies in pre-engineered buildings, for example, are large structural webs with requisite load and weather-element resistance.

A popular type of roof has standing seams, such as the standing seams 25 depicted in FIG. 1. Adjacent sheet metal panels 24 are overlapped and then seamed together to form a weathertight joint between them, the standing seam 25. To make the standing seam 25, light gauge (22 to 24 gauge) sheet metal panels are first rollformed, in a factory or field rollforming machine, to produce upstanding cross-sectional profiles along both sides ("sidelaps"). Typically, these rollforming machines have about 12 to 16 forming stands containing about 18 to 28 die roller sets. The frame can be about 12 to 20 feet long, the forming stands being distributed along the frame. A sidelap is progressively formed as the sheet metal passes through all of the forming stands. At least some of the die roller sets can be rotated by a drive train while they are pressed against the sidelaps, frictionally engaging the sheet metal to move it through the forming stands.

FIG. 3, for example, depicts a rollformed female sidelap 34 along one side of the panel 24. The female sidelap 34 has a characteristic retention cavity at its distal end. As discussed in detail below, the female sidelap 34 consists of a number straight elements having respective lengths, connected together by arcs (curved segments) having respective radii. A generally trapezoidal transition is also rollformed into the panel 24, connecting the female sidelap 34 to the interior portion of the panel 24. A male sidelap 36 and a mirror-image trapezoidal transition is rollformed into the other side of the panel. The male sidelap 36 has a characteristic protuberant element at its distal end.

The differently-shaped sidelaps 34, 36 and transitions are manufactured with different tooling setups in the rollforming machine. The panel is ready for use after both sidelaps 34, 36 have been rollformed. FIG. 5 depicts how a female sidelap $\mathbf{34}_2$ (of a panel $\mathbf{24}_2$) can be placed around a male sidelap $\mathbf{36}_1$ (of another panel $\mathbf{24}_1$). The protuberant element of the male sidelap $\mathbf{36}_1$ interlocks with the retention cavity of the female sidelap $\mathbf{34}_2$, and otherwise the elements and arcs are configured so that the sidelaps $\mathbf{34}_2$, $\mathbf{36}_1$ nest in a closely mating relationship. In these illustrative embodiments, the sidelaps $\mathbf{34}_2$, $\mathbf{36}_1$ have been overlapped with a retention clip 38 sandwiched between them. The clip 38 is used to connect the sidelaps $\mathbf{34}_2$, $\mathbf{36}_1$ to the underlying roof structurals.

After the sidelaps $\mathbf{34}_2$, $\mathbf{36}_1$ have been overlapped and interlocked, at times with one of the clips 38 sandwiched therebetween, a portable seaming machine can be used to seam them together into the weathertight standing seam 25. An illustrative configuration of the standing seam 25 is depicted in FIG. 6. The standing seam 25 fixes the adjacent panels together so that they do not displace with respect to each other, even at high loading. Seamed together, the panels form a structural web having considerable diaphragm strength that is well suited for constructing a roof, while also suited to position and stabilize the underlying support structure in the roof assembly.

However, ordinary process variations can make seaming problematic. For example, part-to-part dimensional variations can result from machine setup or operating error during manufacturing. For example, referring back to FIG. 5, if one of the elements in the profile is longer than expected, that can become problematic in maintaining the desired closely nesting and interlocking relationships during seaming. In conventional rollforming processes, this kind of dimensional variation can lead to creating compressive forces acting on the elements that can plastically distort them and the arcs between them. These kind of distortions, and the associated ripple-effect stresses and strains, compound and propagate to cause distortions in other elements and arcs in the profile. This can defeat the goal of creating a standing seam with the advantageous closely mating and interlocking relationships of the elements and arcs. Similar failures can occur due to other types of ordinary process variations, such as sheet metal material properties like thickness, yield strength, grain structure, and the like. Improvements are needed that compensate for these difficulties in forming a reliable and robust standing seam. It is to those improvements that embodiments of this technology are directed.

SUMMARY

Some embodiments of this technology contemplate a portable sheet metal folding apparatus that folds a sheet metal panel profile into a different predetermined shape, the profile having straight elements joined together by arcs. The apparatus has consecutive roller die sets configured to perform a series of folds on a first element of the profile toward a second element of the profile. Each roller die set has opposing roller dies operably contacting only the first and second elements, respectively, not contacting any arc. The opposing roller dies are arranged to define a minimal gap between them equal to or more than the radius of the arc joining the first and second elements. The gap provides a material relief space that is sized to clearingly permit the arc to positionally shift during folding to relieve stress and strain.

Some embodiments of this technology contemplate a portable sheet metal folding apparatus that folds a sheet metal panel profile into a different predetermined shape, the profile having straight elements joined together by arcs. The apparatus has consecutive roller die sets configured to perform a series of folds on a first element of the profile toward a second element of the profile. Each roller die set has a folding die with a contour defining a material relief space, by operably contacting only the first element and not contacting the arc joining the first and second elements together in each of the folds.

Some embodiments of this technology contemplate a method for folding a sheet metal panel profile into a different predetermined shape, the profile having straight elements joined together by arcs. The method includes a series of consecutive folds on a first element of the profile toward a second element of the profile, each fold finessing the first element toward the second element without otherwise reshaping the arc joining the first and second elements together in each of the folds.

Some embodiments of this technology contemplate a portable multiple-pass folding apparatus for folding a sheet metal profile into a different predetermined shape. The apparatus has a first plurality of folding passes each having a folding die and a corresponding dedicated backup die, and a second plurality of folding passes each having a folding die and a corresponding shared backup die.

Some embodiments of this technology contemplate a portable sheet metal folding apparatus that reshapes a sheet metal panel profile into a different predetermined shape. The profile has straight elements joined together by arcs. The apparatus has consecutive roller die sets configured to perform a series of folds on a first element of the profile toward a second element of the profile. A sequentially first roller die set has opposing roller dies operably contacting only the first and second elements, respectively, not contacting any arc. The opposing roller dies are arranged to define a minimal gap between them equal to or more than the radius of the arc joining the first and second elements, the gap providing a material relief space that is sized to clearingly permit the arc to positionally shift during folding to relieve stress and strain. The first roller die set also has a rake configured to wipe a hook-shaped distal end of the first element closed.

DETAILED DESCRIPTION

Initially, this disclosure is by way of example only, not by limitation. The illustrative constructions and associated methods disclosed herein are not limited to use or application with any specific device or in any specific environment. That is, the disclosed technology is not limited to usage for joining roof panels together as is disclosed in the illustrative embodiments. Thus, although the instrumentalities described herein are for the convenience of explanation, shown and described with respect to exemplary embodiments, the skilled artisan understands that the principles herein may be applied equally in other types of systems and environments involving sheet metal assemblies.

Figure 1:
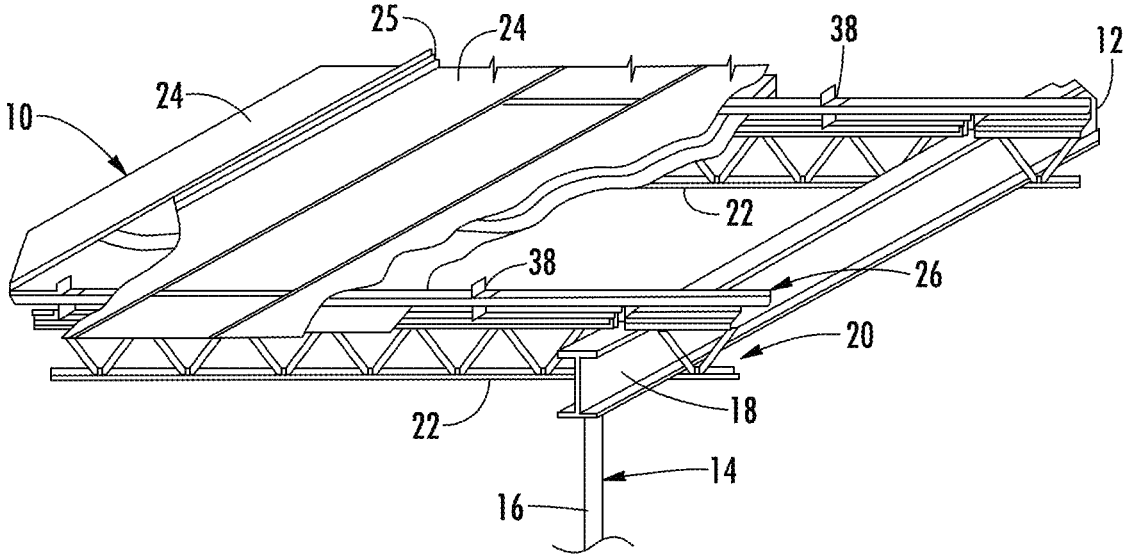
FIG. 1 is an isometric cutaway depiction of a standing seam roof system suited for employing this technology.
Figure 2:
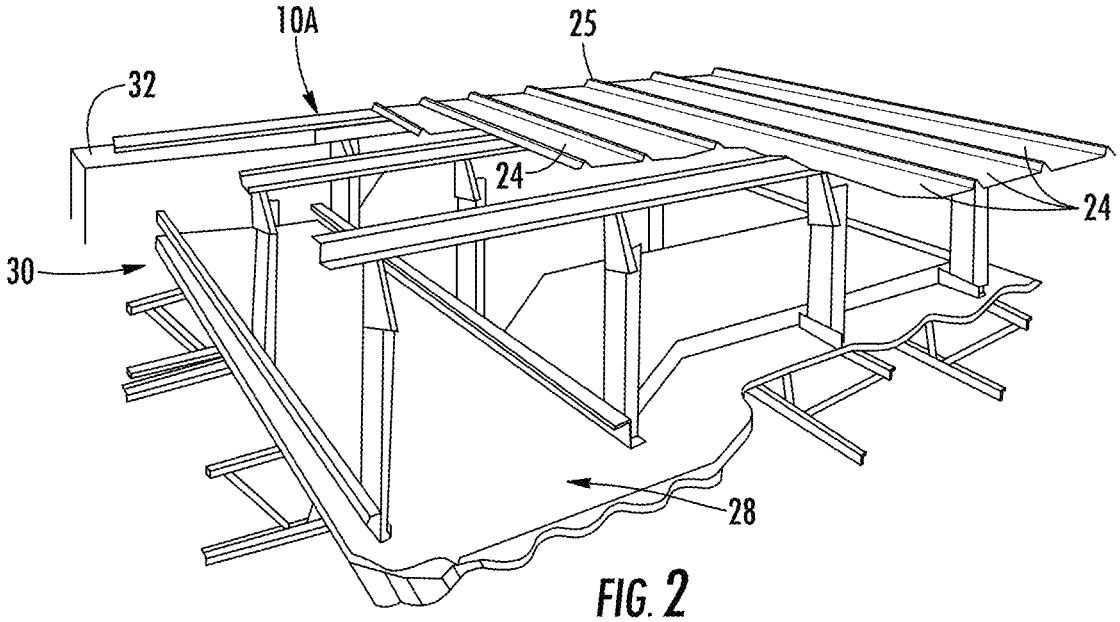
FIG. 2 is an isometric cutaway depiction of a re-roof system that is suited for employing this technology.

Referring to the drawings generally, and beginning more particularly with FIG. 1, shown therein is a pre-engineered building roof 10 as it is supported by a pre-engineered building structure 12. FIGS. 1 and 2 are included for a general description of the environment of standing seam roof assemblies.

The pre-engineered structure 12 has a primary structural system 14 consisting of a plurality of upwardly extending column members 16 rigidly connected to a foundation (not shown). Also, the primary structural system 14 has a plurality of generally sloping primary beams 18 which are supported by the column members 16. A secondary structural system 20 comprises a plurality of open web beams 22 (also called "bar joists") supported by the primary beams 18, generally in a horizontal disposition. It will be understood that cee or zee purlins, or wood beams, can be used as the secondary structurals in lieu of the depicted bar joists 22.

A plurality of roof panels 24 are attached to panel support assemblies 26 that are, in turn, attached to the bar joists 22. Particularly, the roof panels 24 are overlapped along their sides ("sidelaps"), and then the overlapping portions are seamed together to form interlocking standing seams 25. Clips 38 are periodically seamed with the overlapping panels 24 to connect the roof panels 24 to the underlying roof structurals. The panels 24 also overlap at their ends ("endlaps"), meaning there are four layers of overlapping panels in the profile at the endlaps. The seaming processes must compensate for all these variations in the makeup of the seaming profile, in addition to other ordinary process variations such as dimensional and material variations. Fastener penetrations in the roof panels 24 are avoided where possible to minimize leakage points, except at the endlaps and roof perimeters where additional hold-down forces are necessary.

Also useful in re-roofing installations, FIG. 2 shows a portion of a roof system 10A supported by a preexisting roof 28 of a building structure 30 and a plurality of wall members 32. The preexisting roof 28 can be any preexisting roof structure such as a built-up roof connected to and supported by conventional primary and secondary support elements.

Figure 3:
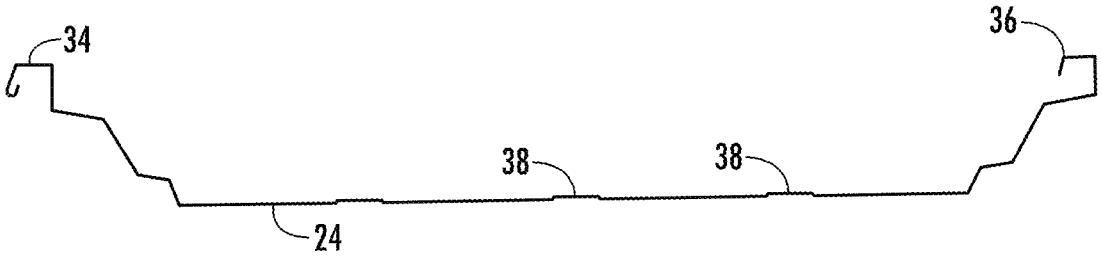
FIG. 3 depicts the cross-sectional profile ("profile") of a sheet metal panel that is well suited for practicing the embodiments of this technology in the systems of FIGS. 1 and 2.
Figure 4:
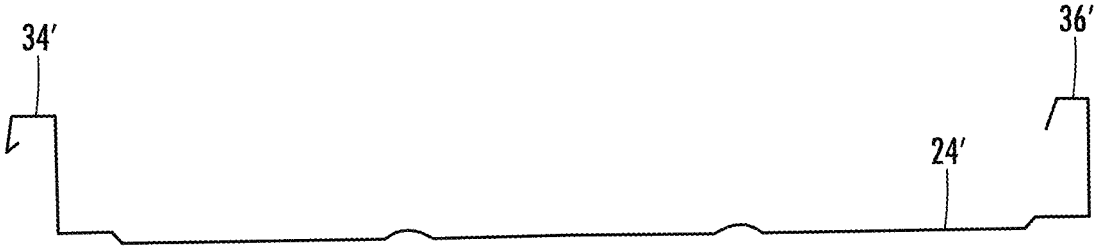
FIG. 4 depicts the profile of another sheet panel that is well suited for practicing the embodiments of this technology in the systems of FIGS. 1 and 2.

FIG. 3 more particularly depicts the roof panel 24 in these illustrative embodiments. Upstanding trapezoidal transitions join a female sidelap portion 34 and a male sidelap portion 36 to the medial portion of the panel 24. The medial portion can define a number of corrugations 38 of selected height for stiffening the panel 24. Although the roof panel 24 depicted in FIG. 3 is well suited for practicing embodiments of this technology, its use in this description is merely illustrative and not limiting of the claimed scope of this technology. For example, FIG. 4 depicts a different roof panel 24' having flat pan transitions instead of trapezoidal transitions, and is likewise well suited for practicing this technology.

Figure 5:
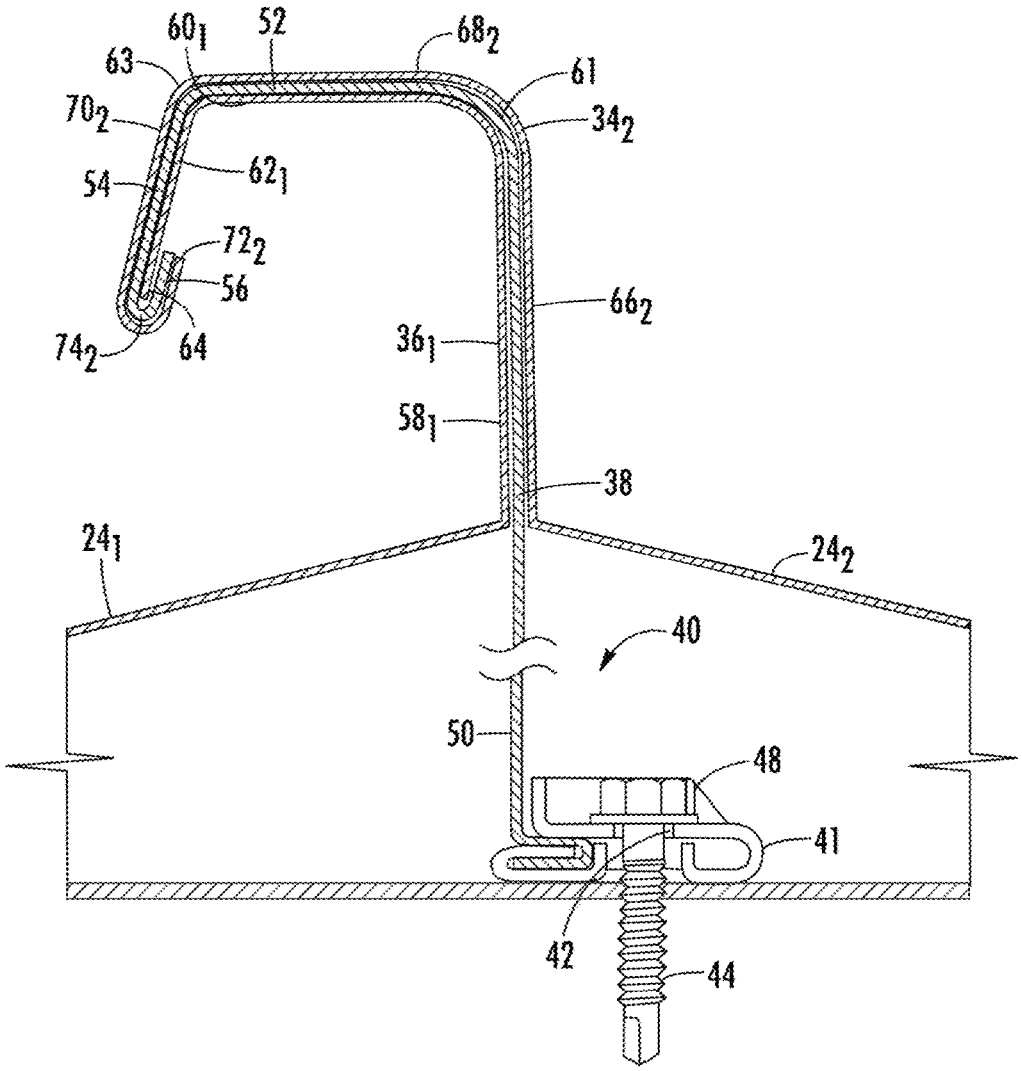
FIG. 5 depicts the sidelap profile of two overlapping panels constructed in accordance with FIG. 3 with an attachment clip sandwiched between the panels.

Turning now to FIG. 5 that depicts two roof panels $\mathbf{24}_1$, $\mathbf{24}_2$ laid flat with the female sidelap portion $\mathbf{34}_2$ (of roof panel $\mathbf{24}_2$) overlapping the male sidelap portion $\mathbf{36}_1$ (of roof panel $\mathbf{24}_1$). At this particular roof location, the clip 38 is sandwiched between the overlapping sidelaps $\mathbf{34}_2$, $\mathbf{36}_1$ for connecting the roof panels 24 to the underlying building support structurals. For purposes of clarity, the clip 38 is cross-hatched to aid the reader in more readily distinguishing its profile. As depicted, the overlapped components desirably have straight elements joined by arcs that nest together in close mating relationships.

The clip 38 as depicted in FIG. 5 is part of a clip assembly 40 having a two-piece construction. An attachment end 41 has apertures 42 through which fasteners 44 extend and are attached in threading engagement with an underlying support, such as in the attachment of the clip assembly 40 to a panel support assembly 26 (FIG. 1, or directly to a bar joist 22). A rim 48 can extend from the head of the fastener 44 for added load transfer. A lower end of the clip 38 interlocks with the attachment end 41 in a sliding relationship, allowing the clip 38 to displace in relation to the attachment end 41 to compensate for roof panel 24 displacements under loading.

In these illustrative embodiments, the clip 38 has a substantially vertical flange 50, a substantially horizontal flange 52, and an angled flange 54 that defines a hook 56 at its distal end. The male sidelap $\mathbf{36}_1$ forms a closely mating relationship with the clip 38, having a substantially vertical straight element $\mathbf{58}_1$, a substantially horizontal straight element $\mathbf{60}_1$, and terminating at an angled straight element $\mathbf{62}_1$. An arc 57 joins the straight elements $\mathbf{58}_1$ and $\mathbf{60}_1$ together, and another arc 59 joins the straight elements $\mathbf{60}_1$ and $\mathbf{62}_1$ together.

The distal ends of the male sidelap $\mathbf{36}_1$ and the clip 38 are interlocked with each other to enhance the strength and sealing capability of the seam 25. Particularly, a distal end of the angled element $\mathbf{62}_1$ (of the male sidelap $\mathbf{36}_1$) is operably disposed within the hook 56 (of the clip 38). This interlocking of the overlapping components increases the amount of upward flexing that the adjacent roof panels 24 can withstand without loss of structural integrity in the seam 25. Disruption of this interlocking relationship during seaming processes can lead to premature failure, such as a leak or even an unfurling of the seamed components.

The female sidelap $\mathbf{34}_2$ similarly has a substantially vertical straight element $\mathbf{66}_2$, a substantially horizontal straight element $\mathbf{68}_2$, and an angled straight element $\mathbf{70}_2$ forming a hook $\mathbf{72}_2$ at its distal end. An arc 61 joins the elements $\mathbf{66}_2$, $\mathbf{68}_2$ together, and another arc 63 joins the elements $\mathbf{68}_2$, $\mathbf{70}_2$ together.

The distal ends of the female sidelap $\mathbf{34}_2$ and the clip 38 are likewise interlocked together to enhance the strength and seal integrity of the seam 25. Here, the hook 56 (of the clip 38) is operably disposed within the hook $\mathbf{72}_2$ (of the female sidelap $\mathbf{34}_2$). The overlapping and interlocked components in FIG. 5 form a profile that is ready for seaming, to produce the standing seam 25 depicted in FIG. 6.

Figure 6:
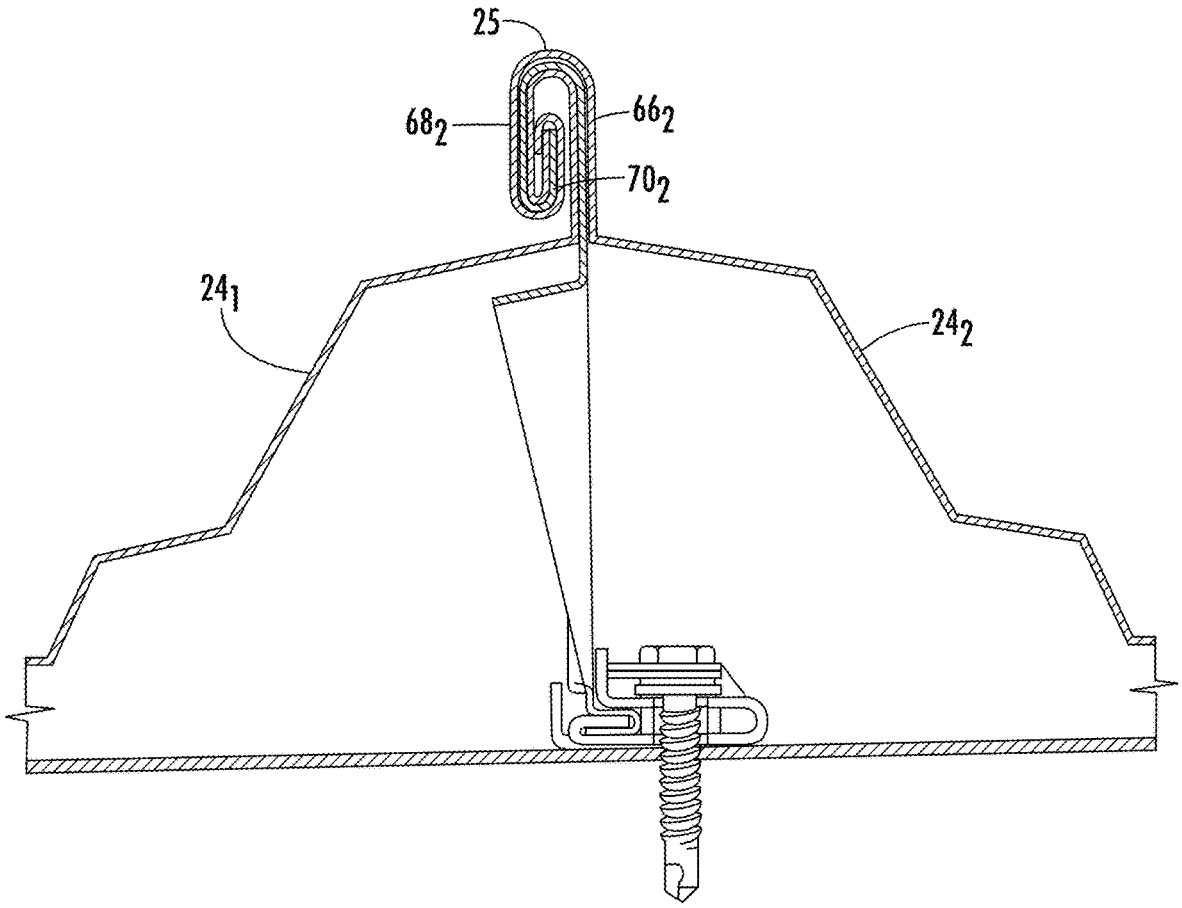
FIG. 6 depicts the standing seam profile after seaming the sidelap profile of FIG. 5 in accordance with embodiments of this technology.

FIG. 6 more particularly depicts the desired standing seam profile, after seaming is completed. Maintaining the closely mating and interlocking relationships during seaming, as depicted, is a critical quality attribute in preserving the requisite seam strength and weathertight seal between the sidelaps $\mathbf{34}_2$, $\mathbf{36}_1$ in the standing seam 25. Although not depicted, sealants can be placed between the components before seaming to enhance the seal against air and moisture migration through the standing seam 25.

In order to seam the overlapping in interlocking sidelaps $\mathbf{34}_2$, $\mathbf{36}_1$ (FIG. 5) into the standing seam 25 depicted in FIG. 6, first the angled element $\mathbf{70}_2$ (of the female sidelap $\mathbf{34}_2$) is re-shaped to be substantially parallel to the horizontal element $\mathbf{68}_2$, and then the horizontal element $\mathbf{68}_2$ is re-shaped to be substantially parallel to the vertical element $\mathbf{66}_2$. Of course, this only describes the re-shaping of the female sidelap $\mathbf{34}_2$, but this process will be described with the presumption that the other two layers (male sidelap $\mathbf{34}_1$ and clip 38) are likewise reshaped to maintain their closely mating and interlocking relationship with each other. So, in a multiple-pass seaming process, the first pass re-shapes the angled element $\mathbf{70}_2$ upwardly toward the horizontal element $\mathbf{68}_2$, reducing the included angle between them.

Figure 7:
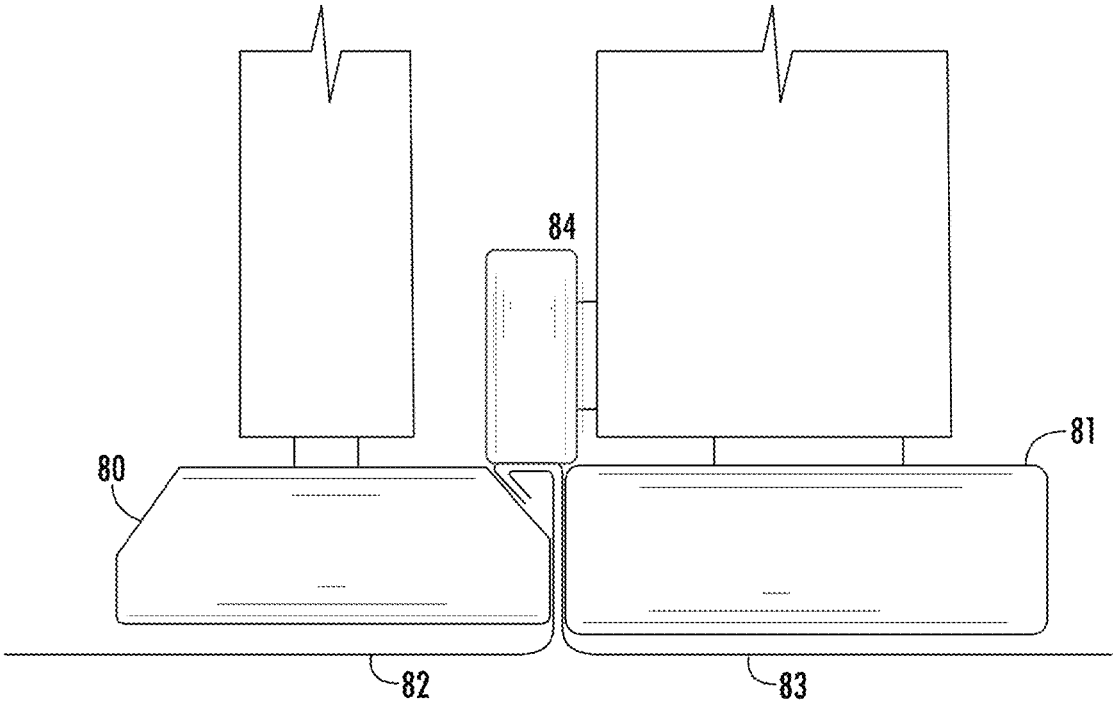
FIG. 7 PRIOR ART
FIG. 7 depicts a rollforming pass used in seaming in accordance with previously attempted solutions.
Figure 8:
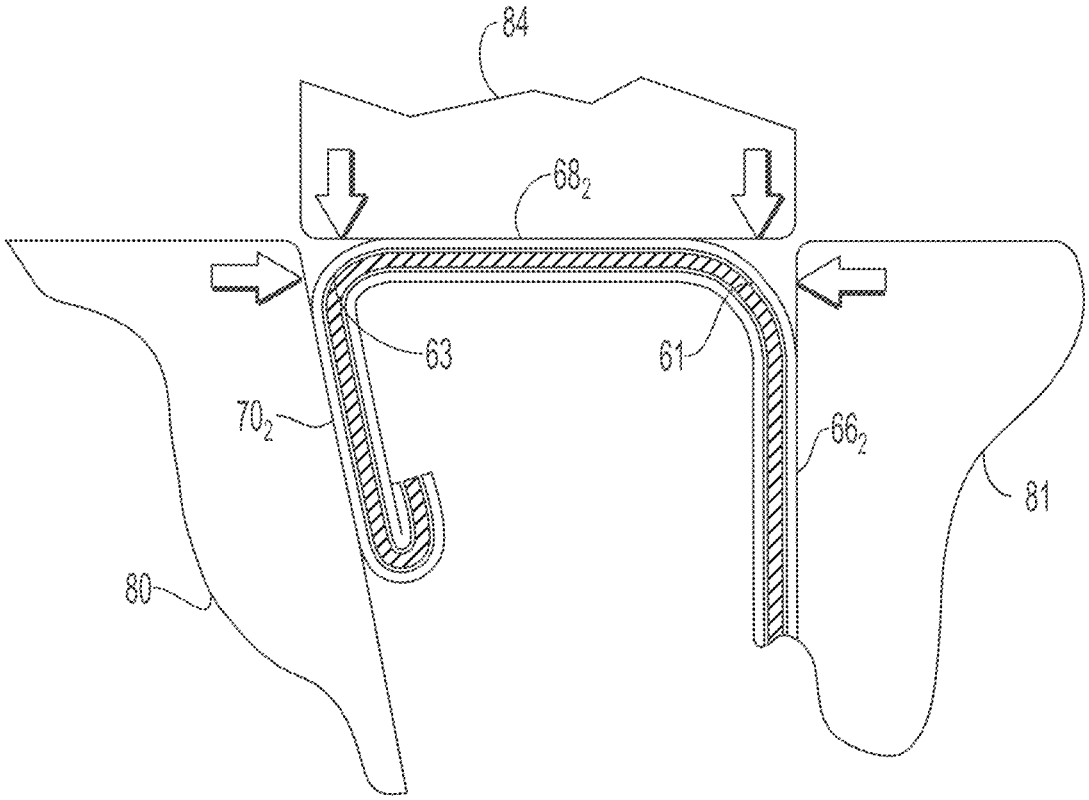
FIG. 8 PRIOR ART
FIG. 8 is an enlarged portion of FIG. 7.

FIG. 7 depicts how that is achieved in previously attempted rollforming solutions. An angled roller die 80 rollforms the angled element $\mathbf{70}_2$, while vertical and horizontal backup dies 81, 84 support the elements $\mathbf{66}_2$, $\mathbf{68}_2$, respectively. FIG. 8 is an enlarged portion of FIG. 7, better depicting how the three roller dies 80, 81, 84 are arranged to pinch the arcs 61, 63 tightly to positionally constrain them during rollforming, as indicated by the bold arrows. The rollforming dies 80, 81, 84 effectively create a cross-sectional pinch point into which the sheet metal profile is subjected by brute forces. The net effect of these brute forces is to not only form the element 702 toward the element 682, but to also compress the element 682 and the arcs 61, 63, positionally constraining them during the rollforming pass.

Figure 9:
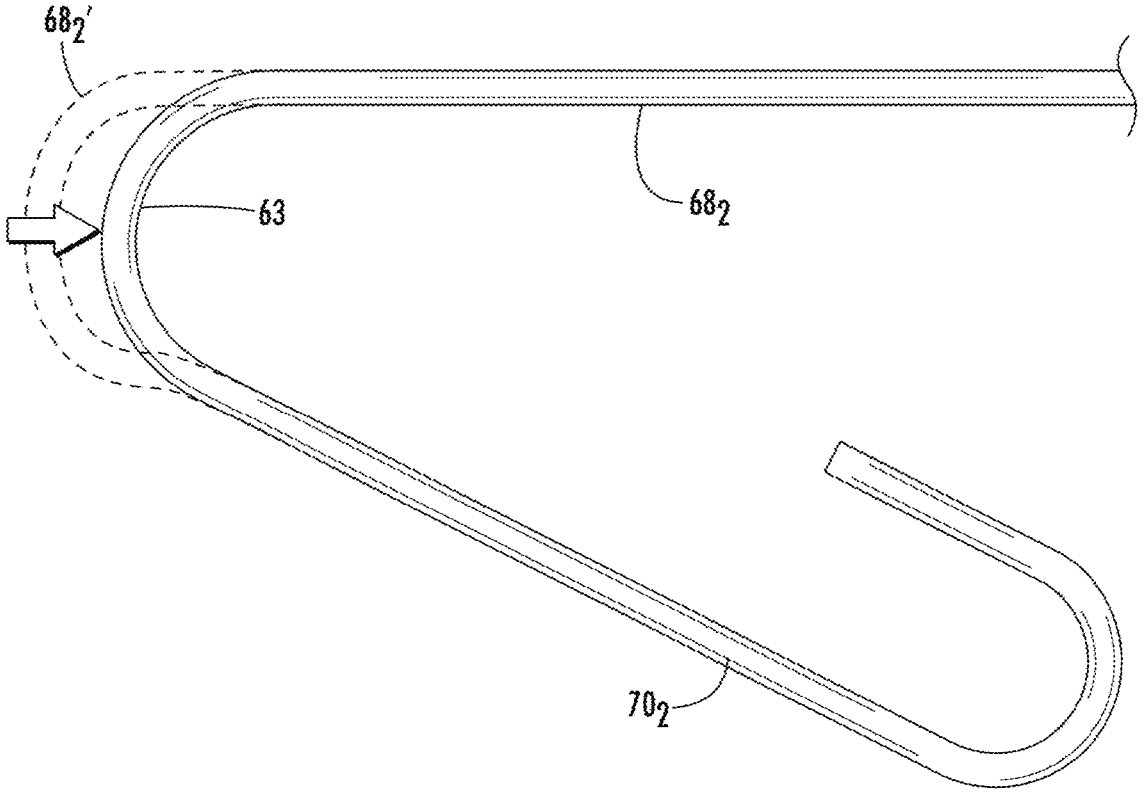
FIG. 9 PRIOR ART
FIGS. 9 and 10 diagrammatically depict how the rollforming pass of FIG. 7 can distort the elements and arcs in the sidelap profile during seaming.
Figure 10:
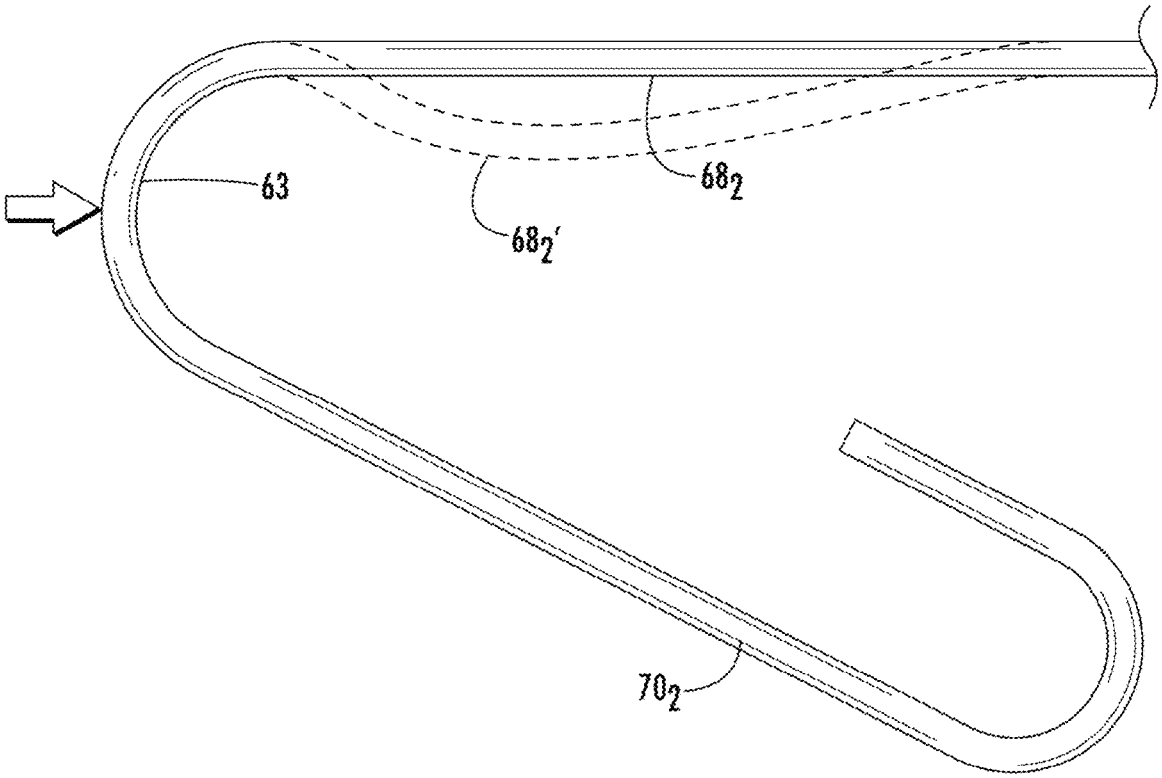
FIG. 10 PRIOR ART

This conventional rollforming process can be problematic in the face of the ordinary process variations discussed above. For example, FIG. 9 depicts how the constrained arc 63 provides no relief space to accommodate a profile having a longer-than-expected horizontal element $\mathbf{68}_2$'. Instead, constraining the arc 63 imparts compressive forces to the horizontal element $\mathbf{68}_2$' that, if large enough, will result in deformation (buckling) as depicted in FIG. 10. Unwanted deformation like this has a compounding negative effect on subsequent rollforming passes, making it more likely to lose the desired closely mating and interlocking relationships of the overlapping elements and arcs during seaming.

Figure 11A:
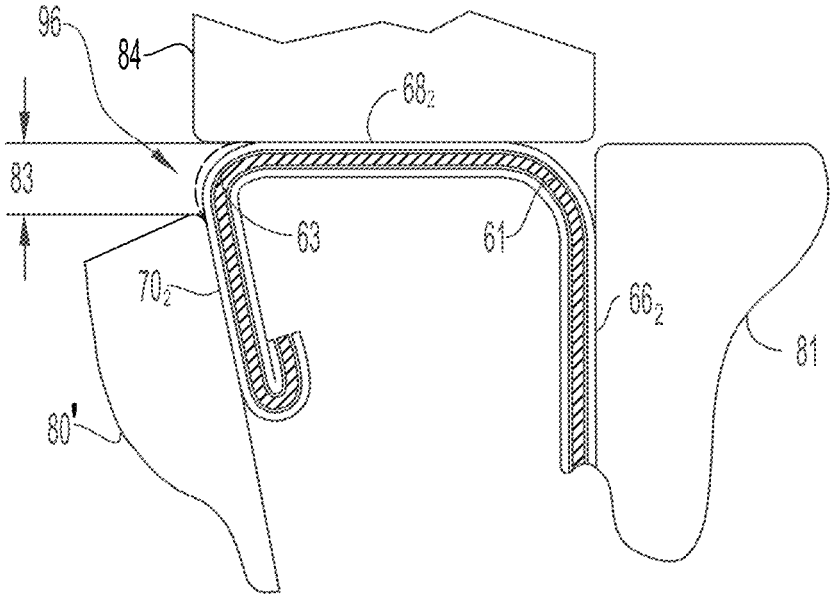
FIG. 11 is a modified version of FIG. 8 depicting the opposing roller dies arranged to provide a material relief space in accordance with this technology.
Figure 11B:
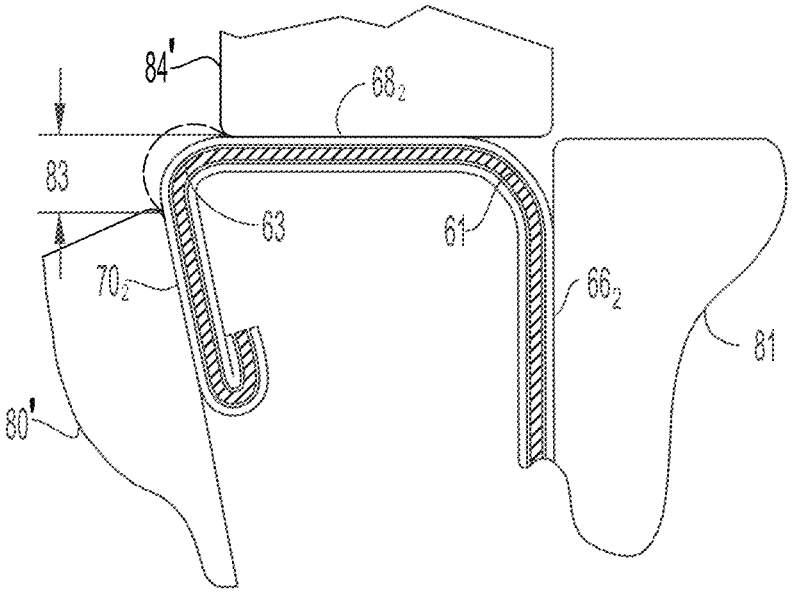
Figure 12:
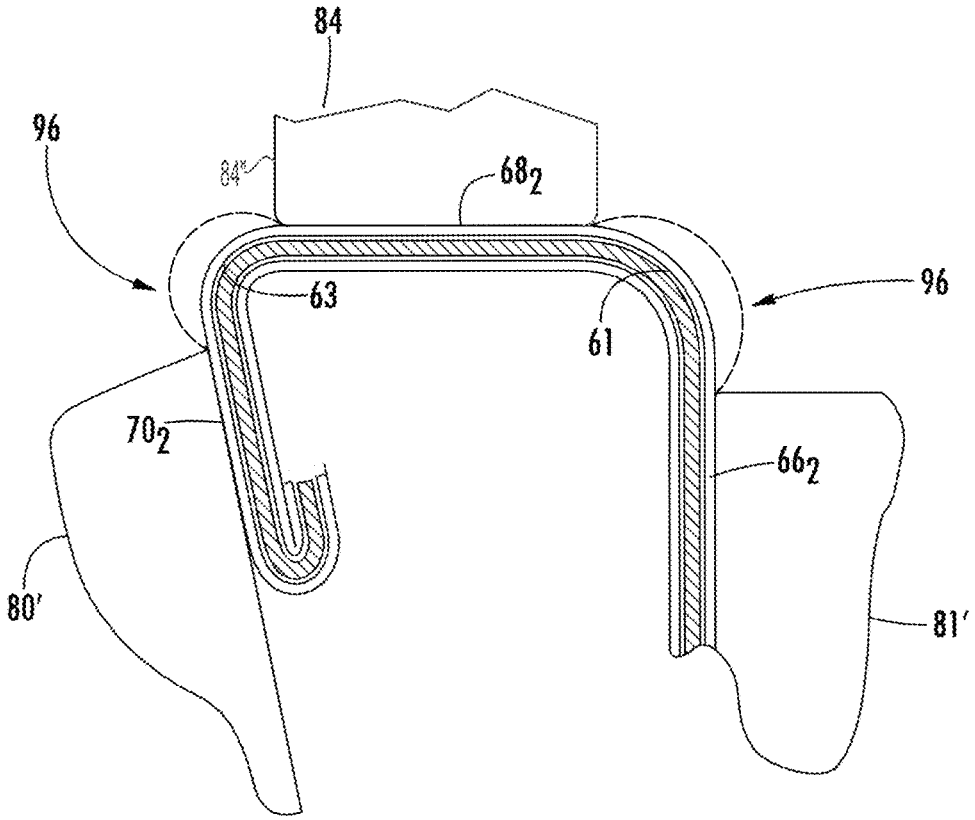
FIG. 12 is similar to FIG. 11 but depicting the roller dies arranged to provide two material relief spaces.

FIG. 11 is a modified version of FIG. 8, showing a different roller die set forming a material relief space 96 between the roller dies 80', 84, in accordance with embodiments of this technology. The roller die 80' is modified so that it only contacts the element $\mathbf{70}_2$ and not the arc 63. Also, the opposing roller dies 80', 84 are spatially separated by a minimum distance, denoted by reference numeral 83, that is equal to or more than the radius of the arc 63. This roller die arrangement opens up the material relief space 96 that is sized to permit the arc 63 to positionally shift during the folding operation, relieving sheet metal stress and strain, and thus preventing the deformations associated with the previously attempted rollforming solutions discussed above. FIG. 12 is similar to FIG. 11 but further showing the roller die 81' having been modified to provide another material relief space for the arc 61.

Figure 13:
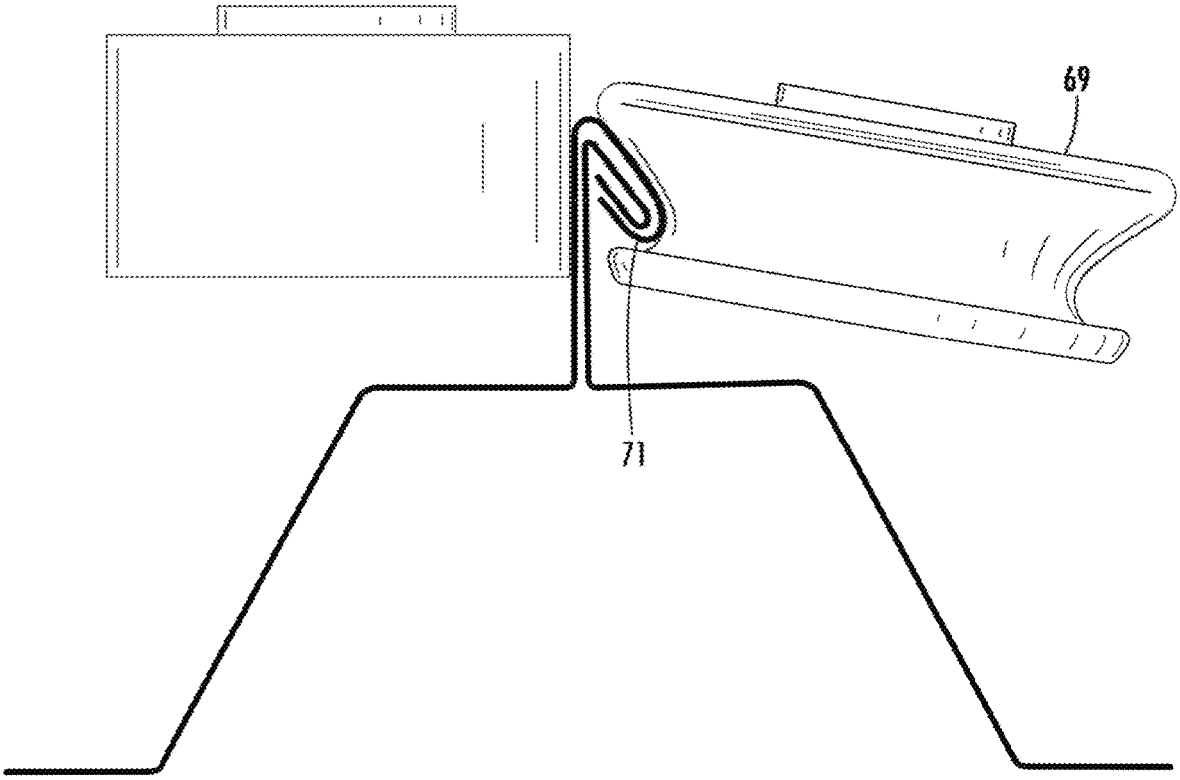
FIG. 13 PRIOR ART
FIG. 13 depicts another typical rollforming pass that is used in seaming in accordance with previously attempted solutions.

In other previously attempted rollforming solutions, pinching the arc tightly and compressing the element is intentionally performed by features built into the tooling. FIG. 13, for example, depicts a rollforming die 69 defining a radiused notch 71 that pinches the hook-shaped end and compresses the element while rollforming it downwardly. This can cause the same kind of unwanted deformation that promotes separation of the interlocked features in the profile.

To resolve these problems, the present technology relieves untoward stresses and strains in the elements and arcs by intentionally providing the material relief space 96 into which they can positionally shift. Unlike the previously attempted rollforming solutions, the present technology does not compress the elements or pinch the arcs tight while seaming. The present reshaping process is referred to as "folding" as opposed to the conventional "rollforming" state of the prior art. "Folding," for purposes of this description and meaning of the claims, means, for instance, that folding die 80' in FIG. 11 finesses the element $\mathbf{70}_2$ toward the element $\mathbf{68}_2$ without otherwise constraining or reshaping the arc 63 joining the elements $\mathbf{68}_2$, $\mathbf{70}_2$. In other words, the folding die $\mathbf{70}_2$ air forms the element $\mathbf{70}_2$, freeing up the arc 63 and the element $\mathbf{68}_2$ to positionally shift during folding, instead of constraining them with brute forces during rollforming.

Figure 14:
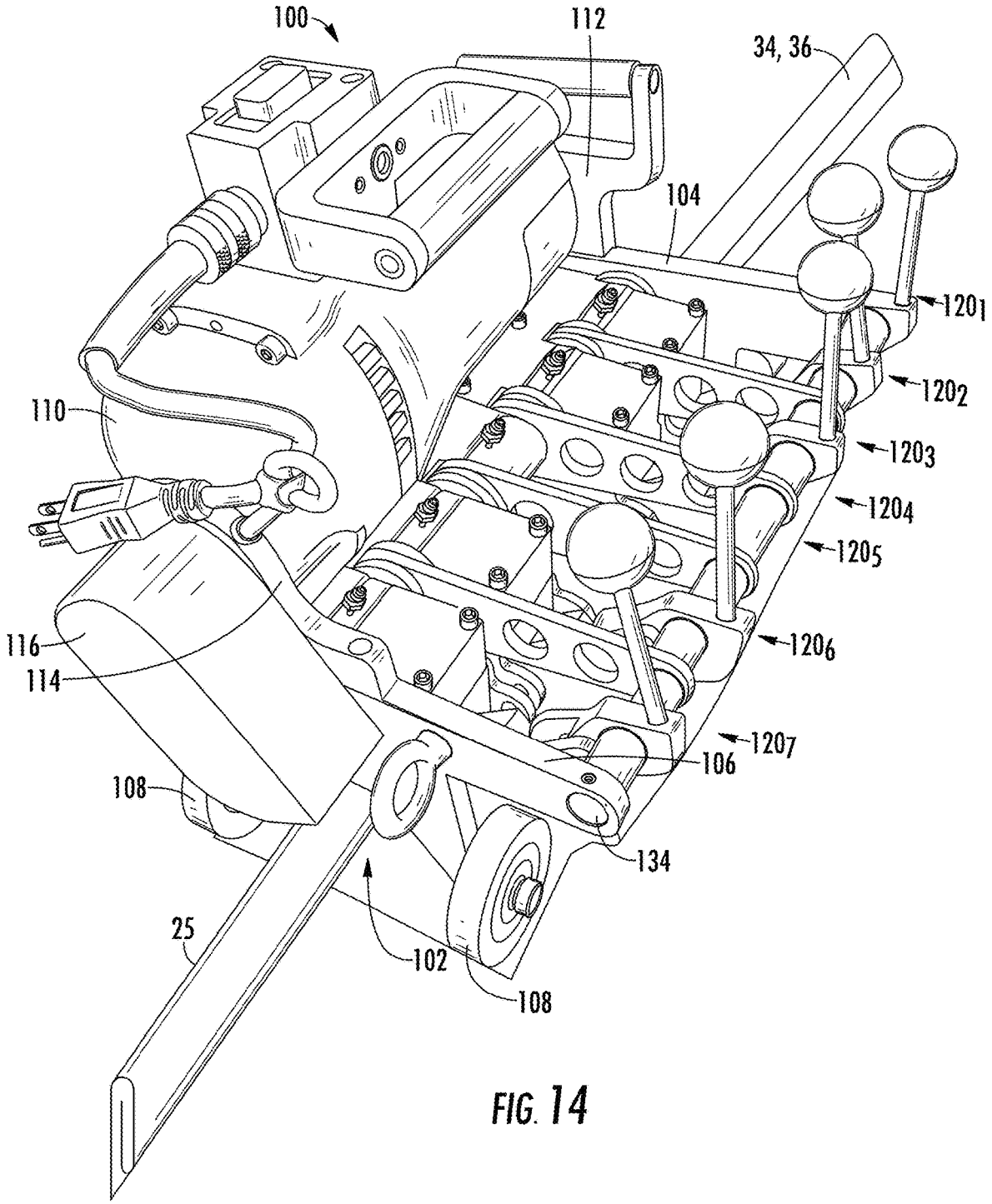
FIG. 14 is an isometric depiction of a sheet metal folding apparatus that is constructed in accordance with embodiments of this technology.

Turning now to FIG. 14, which is an isometric depiction of a portable folding apparatus 100 that is constructed in accordance with illustrative embodiments of this technology. Generally, the folding apparatus 100 has a frame 102 that includes a forward end plate 104 and a rearward end plate 106, with a number of moving and fixed components supported therebetween. A plurality of wheels 108 (only two depicted in FIG. 10) are attached to the plates 104, 106 to roll on the roof 10 (FIG. 1), with a number of roller die sets straddling the sidelaps $\mathbf{34}_2$, $\mathbf{36}_1$. The roller die sets provide multiple folding passes $\mathbf{120}_1$-$\mathbf{120}_7$ that sequentially fold the sidelaps 34, 36 into the standing seam 25, without the disadvantageous deformations associated with the previously attempted rollforming solutions. Again, "folding," for purposes of this description and meaning of the claims, is distinguishable from conventional rollforming processes in that it only applies re-shaping forces to the straight elements, not to the adjoining arcs, creating material relief spaces 96 for the elements and arcs to positionally shift into to relieve stresses and strains during the folding pass.

A motor 110 propels the frame 102 by rotating a selected number of the roller die sets, via a transmission, in a frictional engagement against the sidelaps 34, 36. For purposes of this description and meaning of the claims, the motor, transmission, and power-driven roller dies are referred to as the "drive train." In these illustrative embodiments, the motor 110 is supported upon forward and rear motor mounts 112, 114 that are, in turn, supported upon the plates 104, 106, respectively. The motor 110 has an output shaft (not depicted in FIG. 12) passing through the motor mount 114, but it is covered by a protective shroud 116 in these illustrative embodiments.

Figure 15:
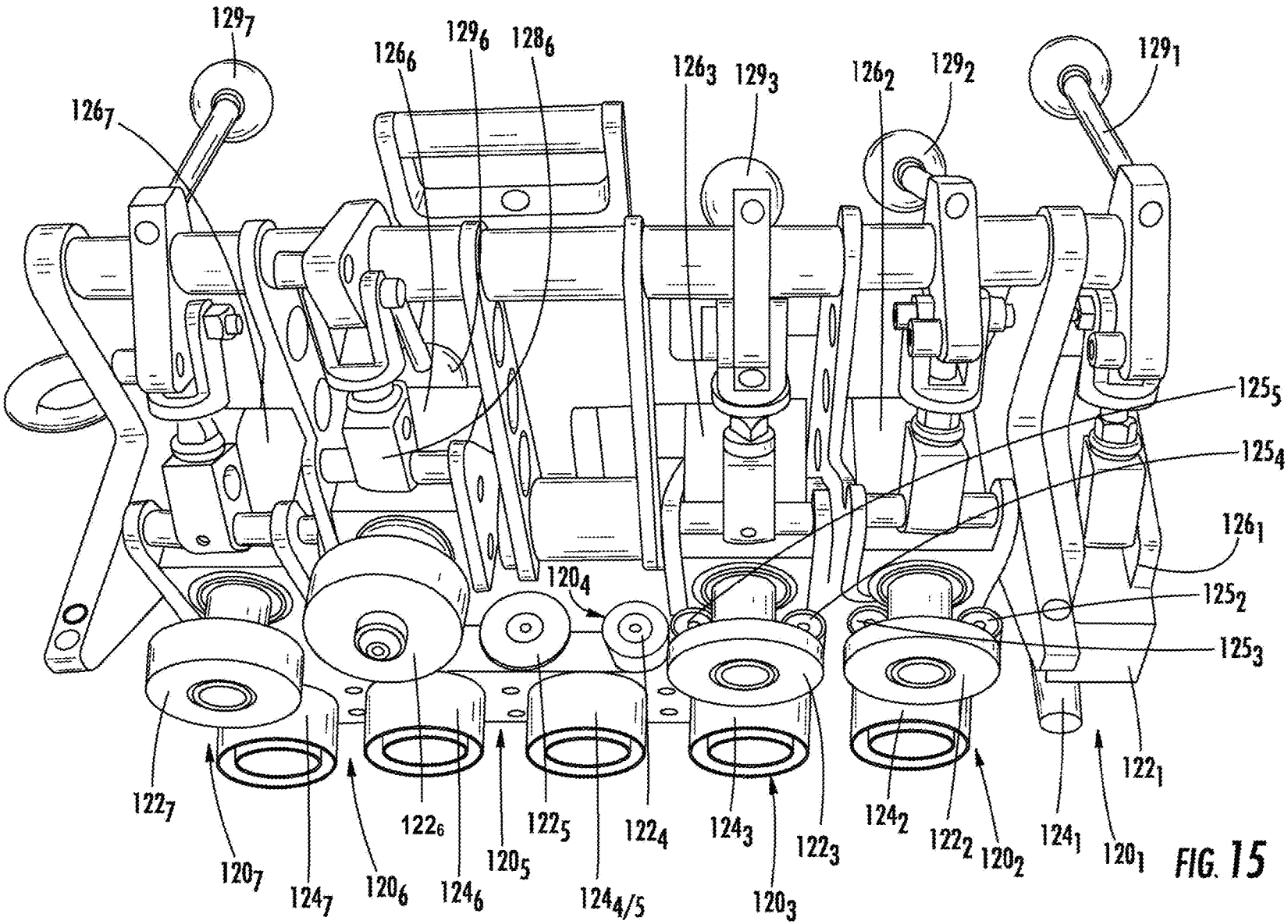
FIG. 15 is a side depiction of the folding apparatus of FIG. 12.

FIG. 15 is a side depiction of the folding apparatus 100 with two wheels 108 removed in the foreground. This better reveals the seven folding passes $\mathbf{120}_1$-$\mathbf{120}_7$ in these illustrative embodiments. Each folding pass 120 is performed by a roller die set that includes a folding roller die ("folding die") and an opposing backup roller die ("backup die"). In these illustrative embodiments, there are seven folding dies $\mathbf{122}_1$-$\mathbf{122}_7$, arranged as a first series of folding passes $\mathbf{120}_1$, $\mathbf{120}_2$, $\mathbf{120}_3$ sequentially folding the angled element $\mathbf{70}_2$ (FIG. 5) upwardly, until it is substantially parallel to the horizontal element $\mathbf{68}_2$. Again, for simplifying this description, it is presumed that the elements and arcs of the male sidelap $\mathbf{36}_1$ and the clip 38 are likewise folded in a manner preserving the closely mating and interlocking relationships of the overlapping components in the profile.

The first series of folds is followed by a second series of folding passes $\mathbf{120}_4$, $\mathbf{120}_5$, $\mathbf{120}_6$, $\mathbf{127}_7$ sequentially folding the horizontal element $\mathbf{68}_2$ to be substantially parallel to the vertical element $\mathbf{66}_2$. In these illustrative embodiments, the first series has three folding passes $\mathbf{120}_1$, $\mathbf{120}_2$, $\mathbf{120}_3$ and the second series has four folding passes $\mathbf{120}_4$, $\mathbf{120}_5$, $\mathbf{120}_6$, $\mathbf{120}_7$. Alternative embodiments of this technology can employ fewer or more than seven total folding passes 120, and fewer or more folding passes in each series.

Six vertical ("vertical-axis") backup dies $\mathbf{124}_1$, $\mathbf{124}_2$, $\mathbf{124}_3$, $\mathbf{124}_{4/5}$, $\mathbf{124}_6$, $\mathbf{124}_7$ support the vertical element $\mathbf{66}_2$ in the folding passes. The fourth vertical backup die $\mathbf{124}_{4/5}$ is so denoted because it is shared by both the fourth and fifth folding dies $\mathbf{122}_4$, $\mathbf{122}_5$; it is included in both the fourth and fifth folding passes $\mathbf{120}_4$, $\mathbf{120}_5$. In these illustrative embodiments, the first vertical backup die $\mathbf{124}_1$ is free-wheeling and the other five vertical backup die rollers $\mathbf{124}_2$, $\mathbf{124}_3$, $\mathbf{124}_{4/5}$, $\mathbf{124}_6$, $\mathbf{124}_7$ are included in the drive train.

There are also five horizontal ("horizontal-axis") backup dies $\mathbf{125}_1$ (not depicted in FIG. 15), $\mathbf{125}_2$, $\mathbf{125}_3$, $\mathbf{125}_4$, $\mathbf{125}_5$ supporting the horizontal element $\mathbf{68}_2$ during the first series of upward folding passes. In these illustrative embodiments, the horizontal backup dies 125 are freewheeling cam rollers.

The fourth and fifth folding dies $\mathbf{122}_4$, $\mathbf{122}_5$ are directly mounted to the frame 102 (FIG. 14) to rotate around fixed-position axes. Each of the other folding dies $\mathbf{122}_1$, $\mathbf{122}_2$, $\mathbf{122}_3$, $\mathbf{122}_6$, $\mathbf{122}_7$ is supported by a selectively positionable tool block $\mathbf{126}_1$, $\mathbf{126}_2$, $\mathbf{126}_3$, $\mathbf{126}_6$, $\mathbf{126}_7$. Linkages 128 connect each positionable tool block 126 to a respective lever 129 that is used to selectively position the tool block 126, as more particularly described in reference to FIGS. 16 and 17.

Figure 16:
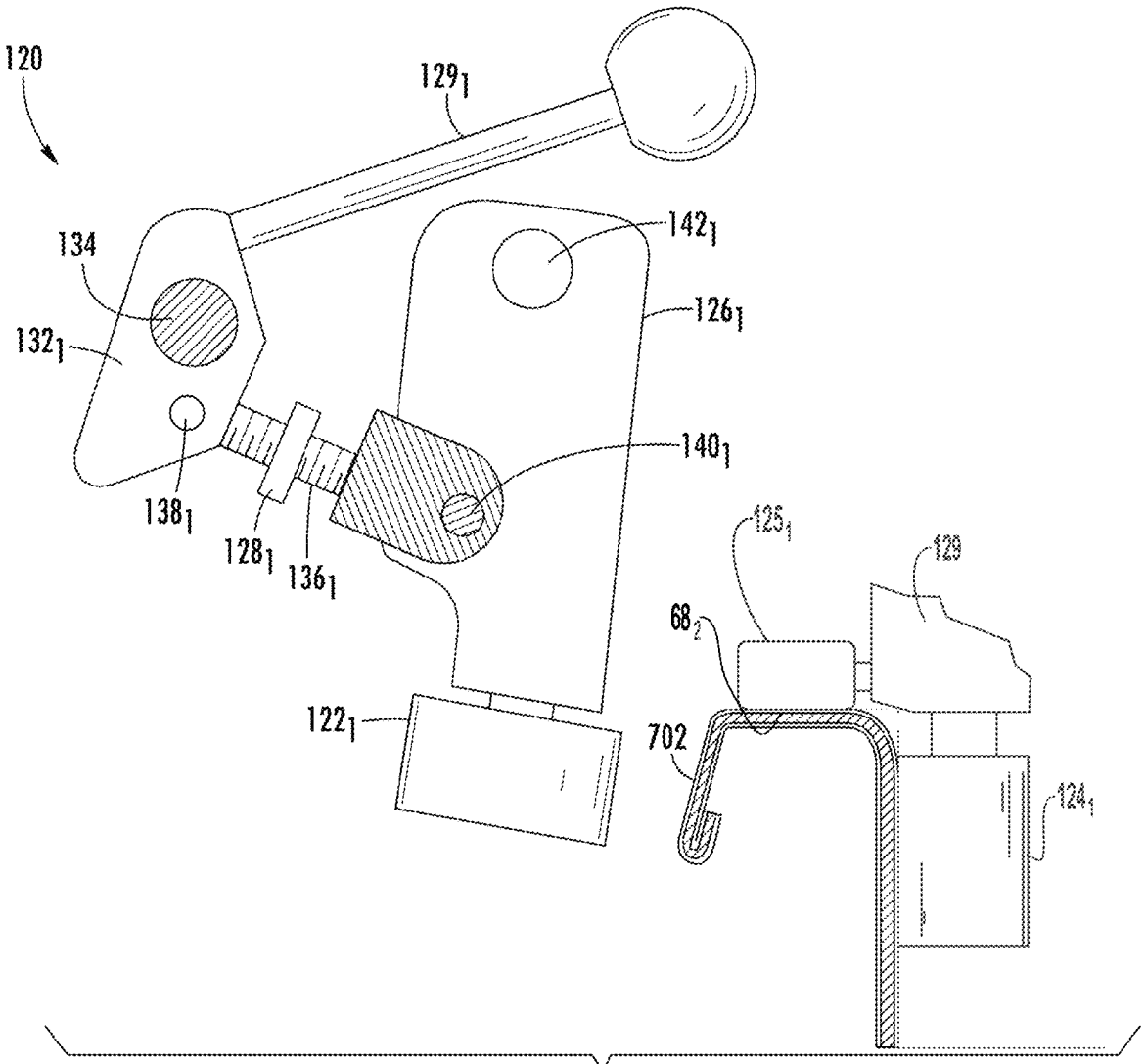
FIGS. 16-18 are side depictions of the first folding pass in the folding apparatus of FIG. 14.

FIG. 16 is a side depiction of the first folding pass $\mathbf{120}_1$. A user selectively positions the lever $\mathbf{129}_1$ to control a cam $\mathbf{132}_1$ that, in turn, positions the positionable tool block $\mathbf{126}_1$ and its folding die $\mathbf{122}_1$. The cam $\mathbf{132}_1$ rotates around a shaft 134 (FIG. 14) and is connected to a proximal end of an adjustable-length rod $\mathbf{136}_1$ at a pivot $\mathbf{138}_1$. A distal end of the rod $\mathbf{136}_1$ is connected to the positionable tool block $\mathbf{126}_1$ at another pivot $\mathbf{140}_1$. The top-end of the positionable tool block $\mathbf{126}_1$ is rotationally supported by the plate 104 (FIG. 14) by a pivot $\mathbf{142}_1$. By this construction, and by lowering and raising the lever $\mathbf{129}_1$, the positionable tool block $\mathbf{126}_1$ is selectively rotatable between the open position depicted in FIG. 16, and the closed position depicted in FIG. 17.

Particularly, lowering the lever $\mathbf{129}_1$ (as depicted in FIG. 16) pulls on the rod $\mathbf{136}_1$ to urge the positionable tool block $\mathbf{126}_1$ to the open position where the folding die $\mathbf{122}_1$ clearingly disengages away from the angled element $70_2$. This clearance that is provided between the folding die $122_1$ and the vertical backup die $124_1$ in the open position permits placing the folding apparatus 100 on the roof so that its roller die sets 122, 124 clearingly straddle the sidelaps $34_2$, $36_1$. In the same way, the clearance provided by the open position permits removing the folding apparatus 100 from the sidelaps $34_2$, $36_1$ (and seam 25).

Figure 17:
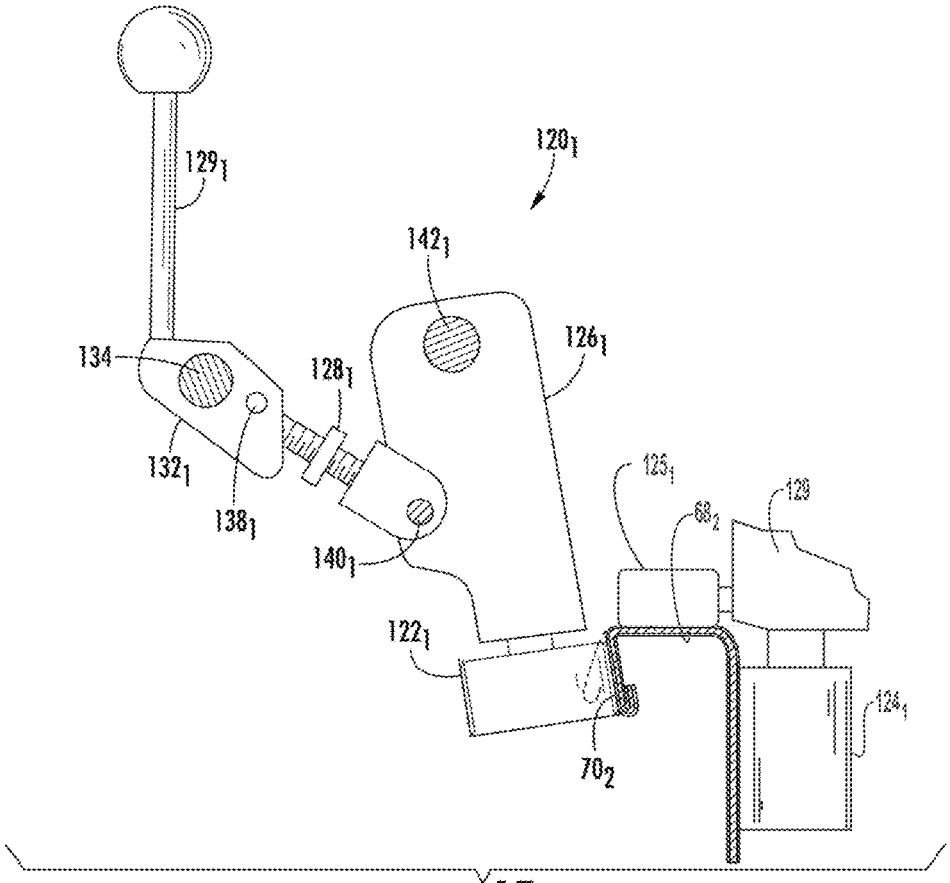

FIG. 17 depicts the user having raised the lever $129_1$, which pushes the rod $136_1$ and, in turn, urges the positionable tool block $126_1$ to the closed position. Here, the folding die $122_1$ contactingly engages the angled element $70_2$ to fold it upwardly toward the horizontal element $68_2$, forming an acute angle therebetween. The opposing vertical and horizontal backup dies $124_1$, $125_1$, respectively, are mounted to a block 129 that is, in turn, supported on the outside surface of the plate 104 (FIG. 14).

Thus, for compactness sake, in these illustrative embodiments the first folding pass $120_1$ is supported on the outside surface of the leading plate 104, with respect to the direction of travel during the seaming process. However, the contemplated embodiments are not so limited. In alternative embodiments, the first folding pass $120_1$ can be mounted between the plates 102, 104 like the other folding passes $120_{2\text{-}7}$. Also, although in these illustrative embodiments all of the roller dies $122_1$, $124_1$, $125_1$ in the first folding pass $120_1$ are freewheeling, the contemplated embodiments are not so limited. In alternative embodiments, one or all of them can be included in the drive train as described herein.

Figure 18:
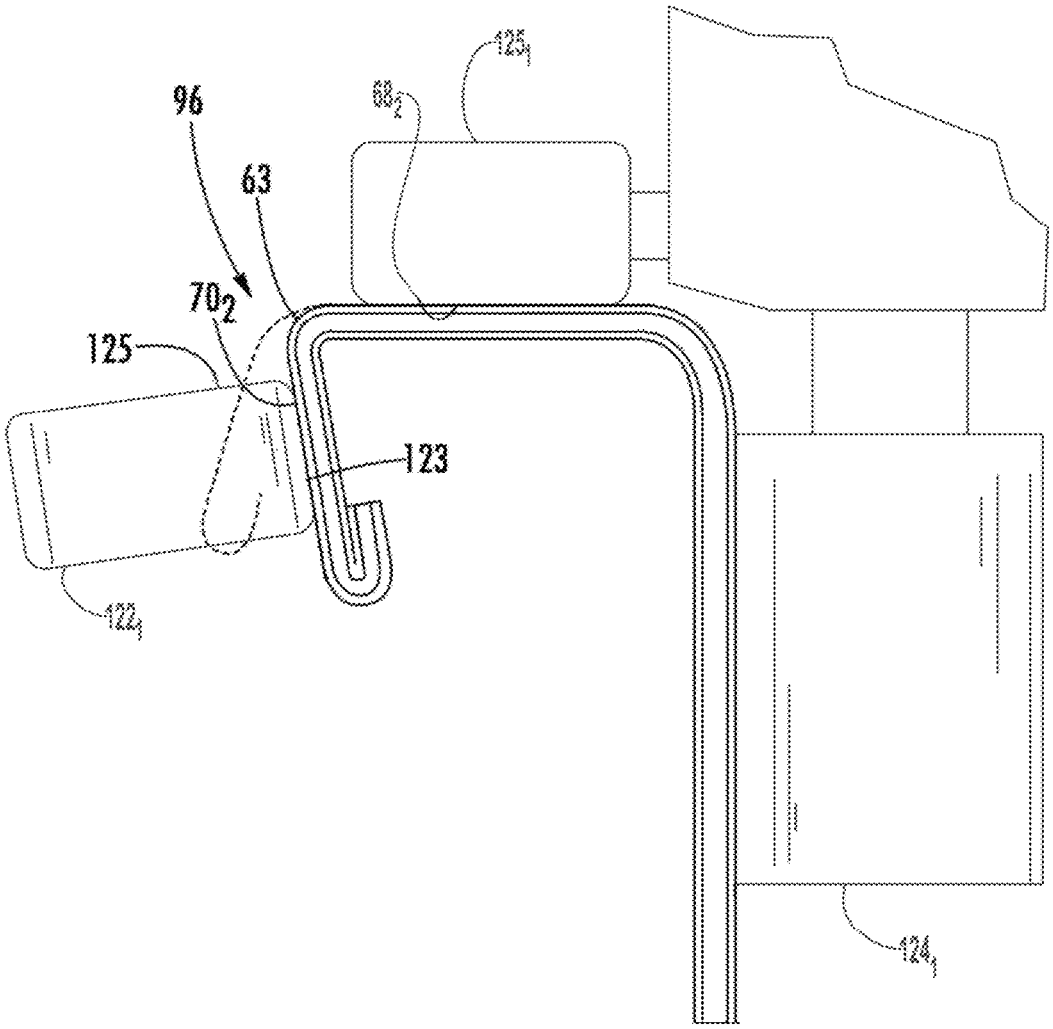

FIG. 18 is an enlarged portion of FIG. 17, more particularly depicting how the present technology is distinguishable from the previously attempted rollforming solutions. The folding die $122_1$ defines a folding surface 123 that is sized and operably positioned to contact against only the straight angled element $70_2$, not contacting the arc 63 or the other arc in the hook-shaped distal end. The folding surface 123 terminates at an upper clearance surface 125 extending away from the angled element $70_2$. The minimum spacing between the roller dies $122_1$, $125_1$ is at least as large as the radius of the arc 63. That provides the material relief space 96 that is sized and positioned to clearingly disengage from the arc 63. The material relief space 96 allows the arc 63 and the element $68_2$ to positionally shift during the folding process, relieving stresses and strains that otherwise cause untoward deformation.

Figure 19:
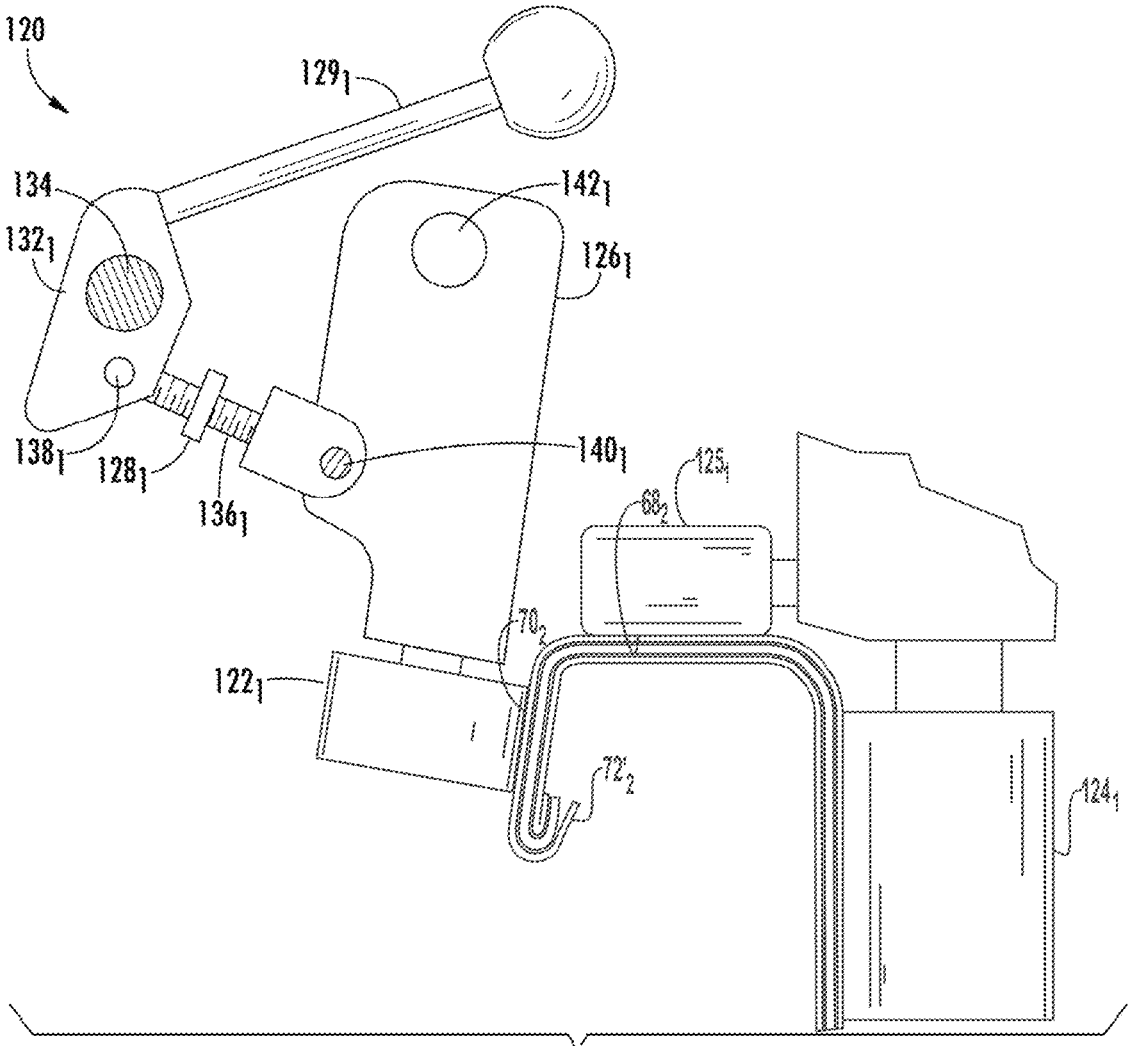
FIG. 19 is similar to FIG. 16 but depicting an alternative female sidelap having an underformed hook at the distal end.
Figure 20:
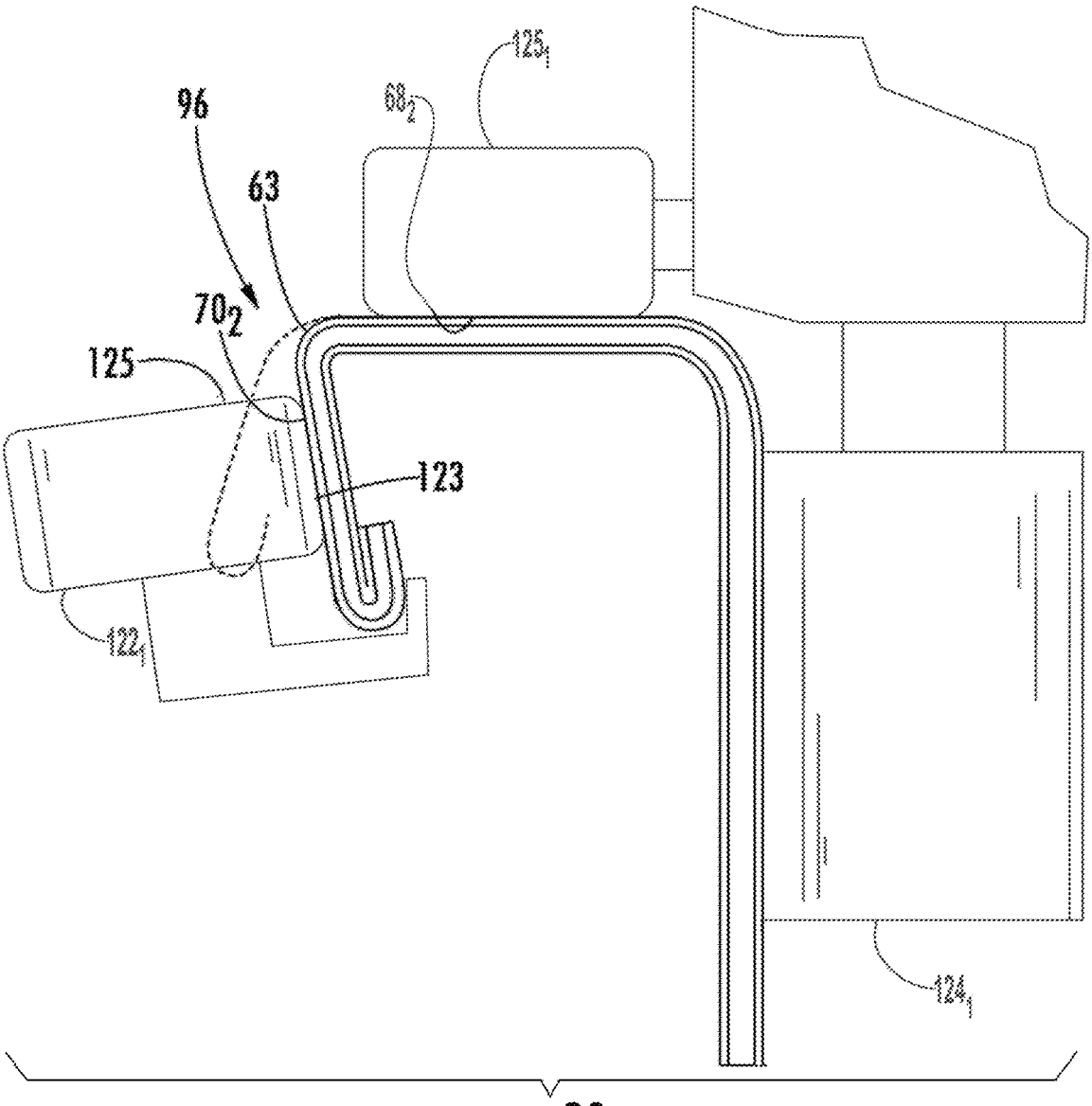
FIG. 20 is similar to FIG. 18 but depicting an additional tool in the first folding pass wiping the underformed hook of FIG. 19.

FIG. 19 is similar to FIG. 16, but depicting an alternative female sidelap having a comparatively underformed hook end $72_2$', which would facilitate overlapping and interlocking the sidelaps and clip together before they are seamed. However, leaving the hook $72_2$' underformed like this during the folding passes would diminish the interlocking engagement of the components at their distal ends, making it more likely that they separate from each other. FIG. 20 is similar to FIG. 18, but depicting a stationary rake 117 mounted to the central frame 102 directly behind the folding die $122_1$. The rake 117 forms a distal prong that wipes the underformed hook $72_2$' closed, swaging it against the clip 38 and the male sidelap $34_1$ to interlock them more tightly together.

Figure 21:
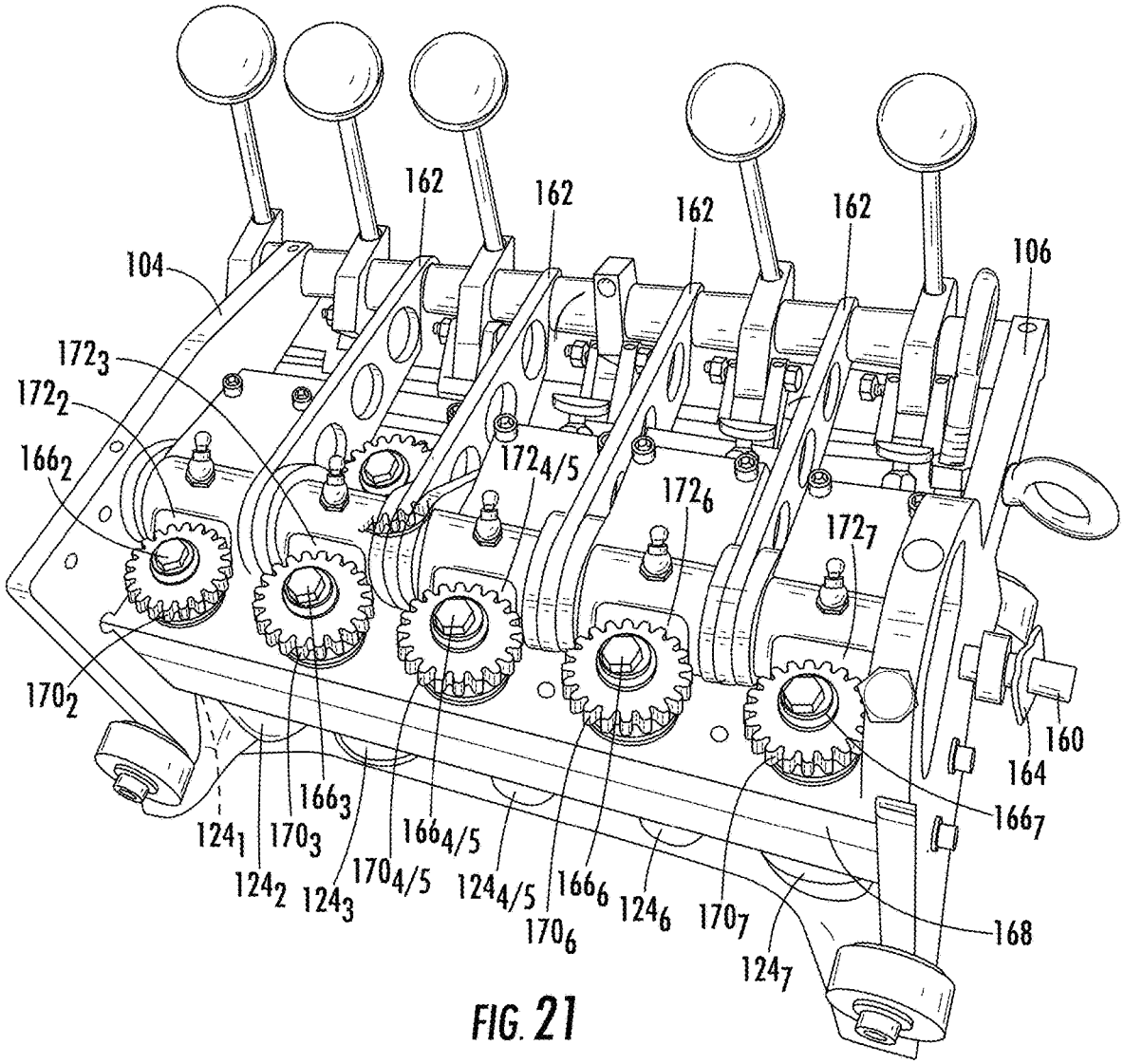
FIGS. 21 and 22 are further depictions of the folding apparatus of FIG. 14.
Figure 22:
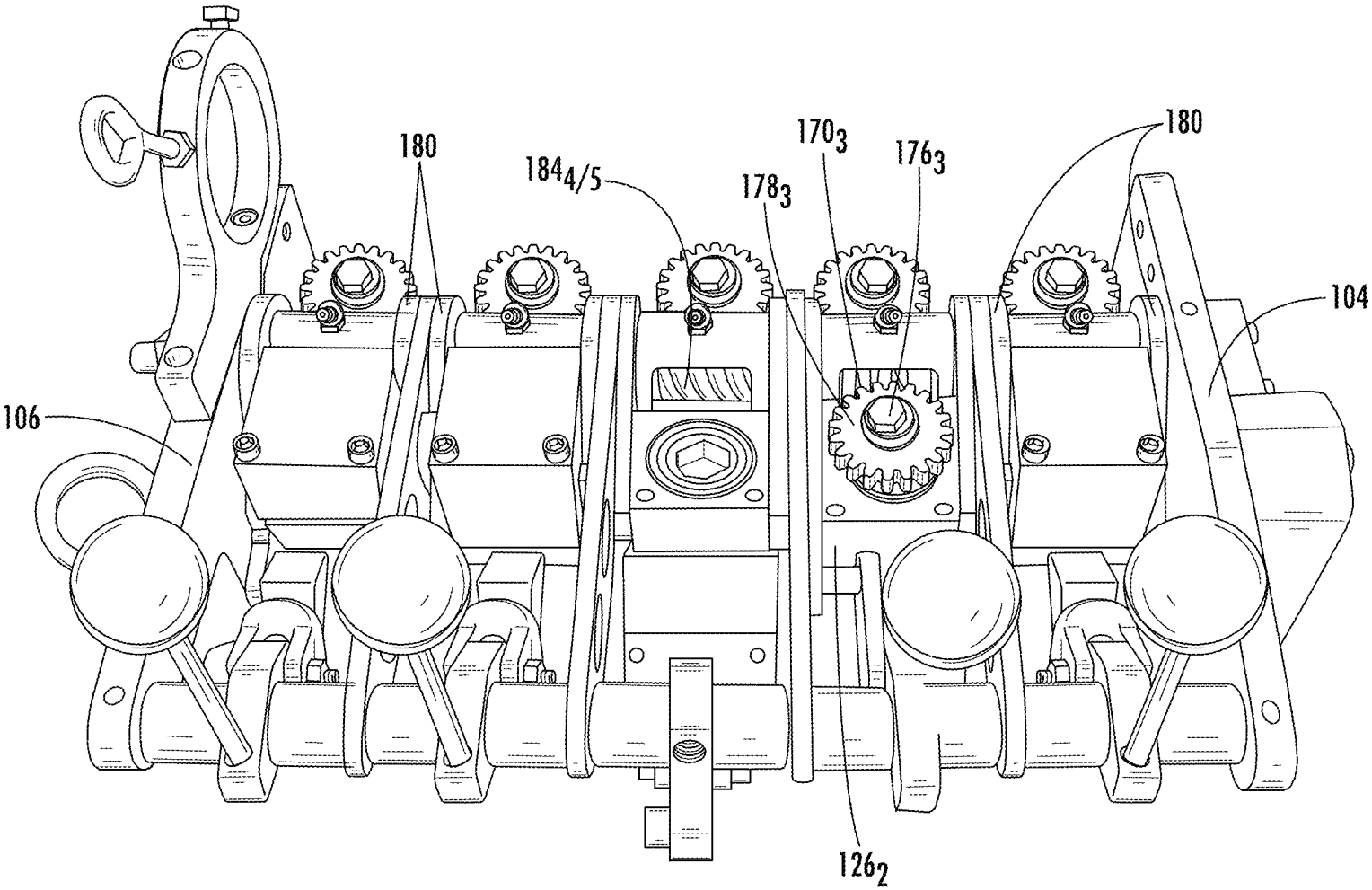

FIGS. 21 and 22 are similar to FIGS. 14 and 15, but depict some covers removed to reveal the transmission works. In these illustrative embodiments, a driveshaft 160 is journaled at both ends by the plates 104, 106, and at four intermediate supports 162 therebetween. A sprocket 164 is fixed in rotation with the driveshaft 160, and a chain (not depicted) is trained around the sprocket 164 to rotate the driveshaft 160.

In these illustrative embodiments, the first backup die $124_1$ is freewheeling but each of the rest of the backup dies $124_2$-$124_7$ is included in the drive train, meaning they are powered by the motor 110 via the transmission works and they are urged into a contacting engagement against the sidelaps 34, 36 when the lever 39 is pulled upward to place the respective positionable tool block 126 in the closed position.

Furthermore, each of the backup dies 124 is fixed in rotation with a respective shaft 166 that is journaled by a stationary tool block 168. Each shaft 166 supports a worm gear 170 adjacent the driveshaft 160. The driveshaft 160 supports a respective worm 172 that meshes with the respective worm gear 170, transmitting rotation of the driveshaft 160 into rotation of each shaft 166 and, in turn, rotation of the respective backup die 124 on the bottom side of the stationary tool block 168. Accordingly, the motor 110 rotates the driveshaft 160 that, in turn, rotates each of the backup dies $124_2$, $124_3$, $124_{4/5}$, $124_6$, $124_7$.

FIG. 22 is similar to FIG. 21 but depicting the opposing side, more fully showing how the transmission works rotates the folding dies $122_2$, $122_3$, $122_6$, $122_7$. For instance, similar to the backup die $124_3$, the folding die $122_3$ (FIG. 15) in the third folding pass $120_3$ is rotated by the motor 110 (FIG. 14) via the transmission works. Particularly, a shaft $176_3$ is journaled by the positionable tool block $126_3$, with the folding die $122_3$ fixed in rotation with it on the bottom-side of the positionable tool block $126_3$. A worm gear $178_3$ is attached to the shaft $176_3$ on the top-side of the positionable tool block $126_3$. A worm $170_3$ on the driveshaft 160 meshes with the worm gear $178_3$, transmitting rotation of the driveshaft 160 into rotation of the shaft $176_3$ and, in turn, rotation of the folding die $122_3$. Accordingly, the motor 110 rotates the driveshaft 160 that, in turn, rotates the folding die $122_3$.

In like constructions, other folding dies $122_2$, $122_6$, $122_7$ journaled by respective positionable tool blocks $126_2$, $126_6$, $126_7$ are rotated by the motor 110 via the transmission works in these illustrative embodiments. Note that in these illustrative embodiments the fourth and fifth folding passes $120_4$, $120_5$ do not have a folding die 122 supported by a positionable tool block 126, so the worm $170_4$ (FIG. 21) only meshes with the worm gear $170_4$ to drive the respective backup die $124_{4/5}$. Instead, in these illustrative embodiments the folding dies $122_4$, $122_5$ in the fourth and fifth folding passes $120_4$, $120_5$ are freewheeling tapered cam rollers that are supported for rotation by the stationary tool block 168.

FIG. 22 also more particularly depicts how the positionable tool blocks 126 are supported by the frame 102 for selective rotation between the open and closed positions. Each of the internal positionable tool blocks $126_2$, $126_3$, $126_6$, $126_7$ are supported by a pair of opposing outriggers 180 that are rotatable around a tube 182 surrounding the driveshaft 160. Openings 184 are formed in the tube 182 that are sized to permit the worm gear 178 to mesh with the worm 172 at both the open and closed positions, and at intermediate positions there between.

Figure 23:
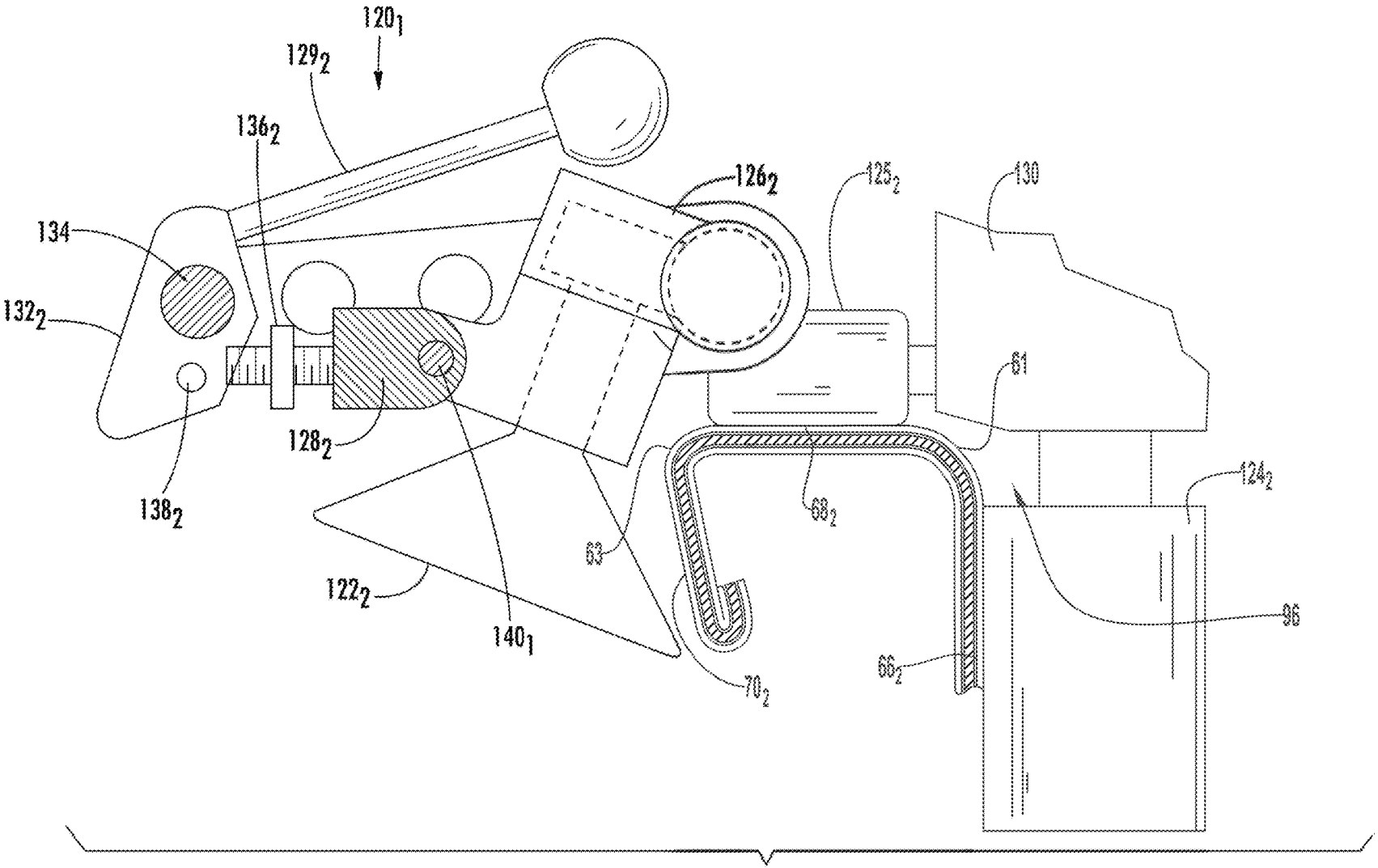
FIGS. 23 and 24 are side depictions of the second folding pass in the folding apparatus of FIG. 14.

Turning now to discussing the rest of the internal folding passes $120_{2\text{-}7}$ in these illustrative embodiments. FIG. 23 is a side depiction similar to FIG. 16, but of the second folding pass $120_2$. Essentially the same tool holding construction is employed here and in several other folding passes $120_3$, $120_6$, $120_7$, except for differently-shaped folding dies 122. As described above, a user positions the lever $129_2$ to control a cam $132_2$ that, in turn, positions the positionable tool block $126_2$ and its folding die $122_2$. The top-end of the positionable tool block $126_2$ is supported by the outriggers 1803 that rotate around the tube 182 surrounding the drive shaft 160 and the worm 1702 attached thereto. By this construction, the positionable tool block $\mathbf{126}_2$ is selectively rotatable between the open position depicted in FIG. 23 and the closed position depicted in FIG. 24.

Figure 24:
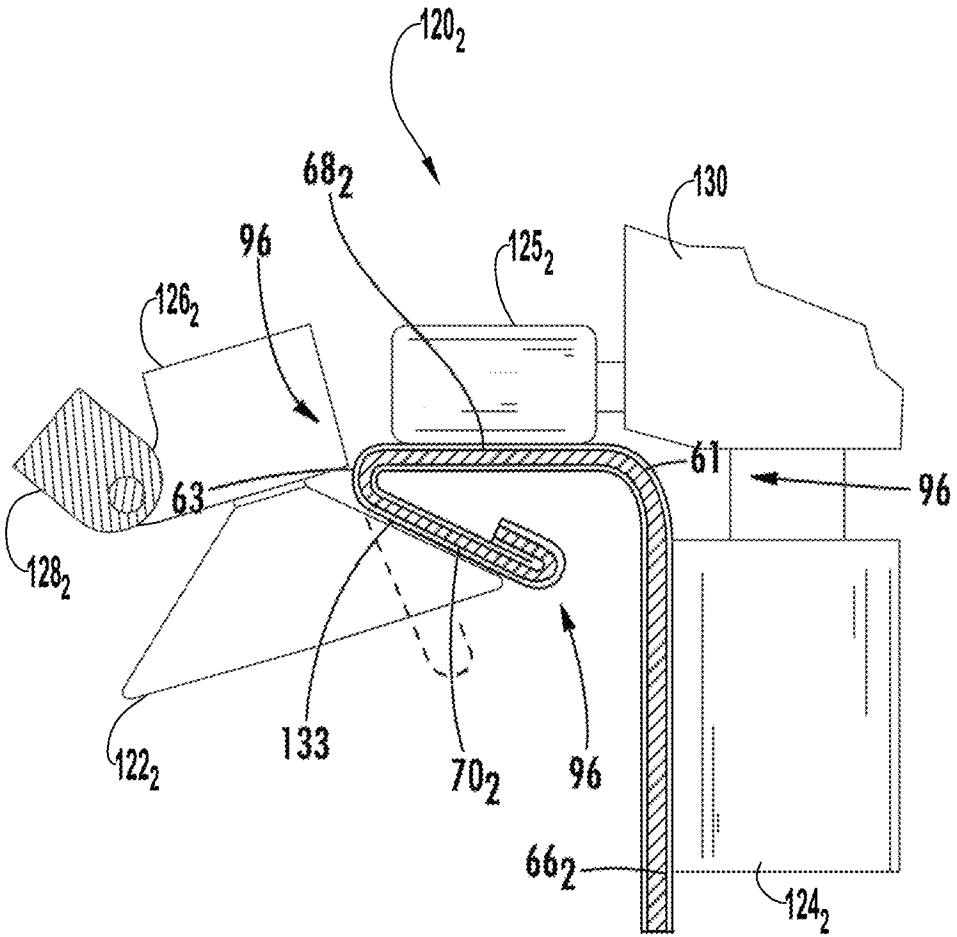

Accordingly, lowering the lever $\mathbf{129}_2$ (as depicted in FIG. 23) pulls on the rod $\mathbf{136}_2$ to urge the positionable tool block $\mathbf{126}_2$ to the open position, and raising the lever $\mathbf{129}_2$ pushes the rod $\mathbf{136}_1$ to urge the positionable tool block $\mathbf{126}_2$ into the closed position (as depicted in FIG. 24). The vertical backup die $\mathbf{124}_2$ supports the vertical element $\mathbf{66}_2$ during folding, and the horizontal backup dies $\mathbf{125}_2$, $\mathbf{125}_3$ support the horizontal element $\mathbf{68}_2$ during folding. In these illustrative embodiments, both the folding die $\mathbf{122}_2$ and the vertical backup die $\mathbf{124}_2$ are included in the drive train, whereas the horizontal backup dies $\mathbf{125}_2$, $\mathbf{125}_3$ are freewheeling.

Similar to the first folding pass $\mathbf{120}_1$, instead of pinching the arc 63 tight, the folding die $\mathbf{122}_2$ is shaped to define a folding surface 133 that is sized and operably positioned to contact against only the straight angled element $\mathbf{70}_2$, not the arc 63. The opposing roller dies $\mathbf{122}_2$, $\mathbf{125}_2$ are arranged with a minimal spacing to define a gap that is at least the same, or larger, than the radius of arc 63, defining the material relief space 96 adjacent the arc 63. Likewise, the backup die $\mathbf{124}_2$ contacts only the element $\mathbf{66}_2$, not the arc 61, and is minimally spaced from the opposing die $\mathbf{125}_2$ to form another material relief space 96 adjacent the arc 61. The material relief spaces 96 adjacent the arcs 61, 63 free them and the element $\mathbf{68}_2$ up to positionally shift during folding, as needed, to relieve stresses and strains.

Figure 25:
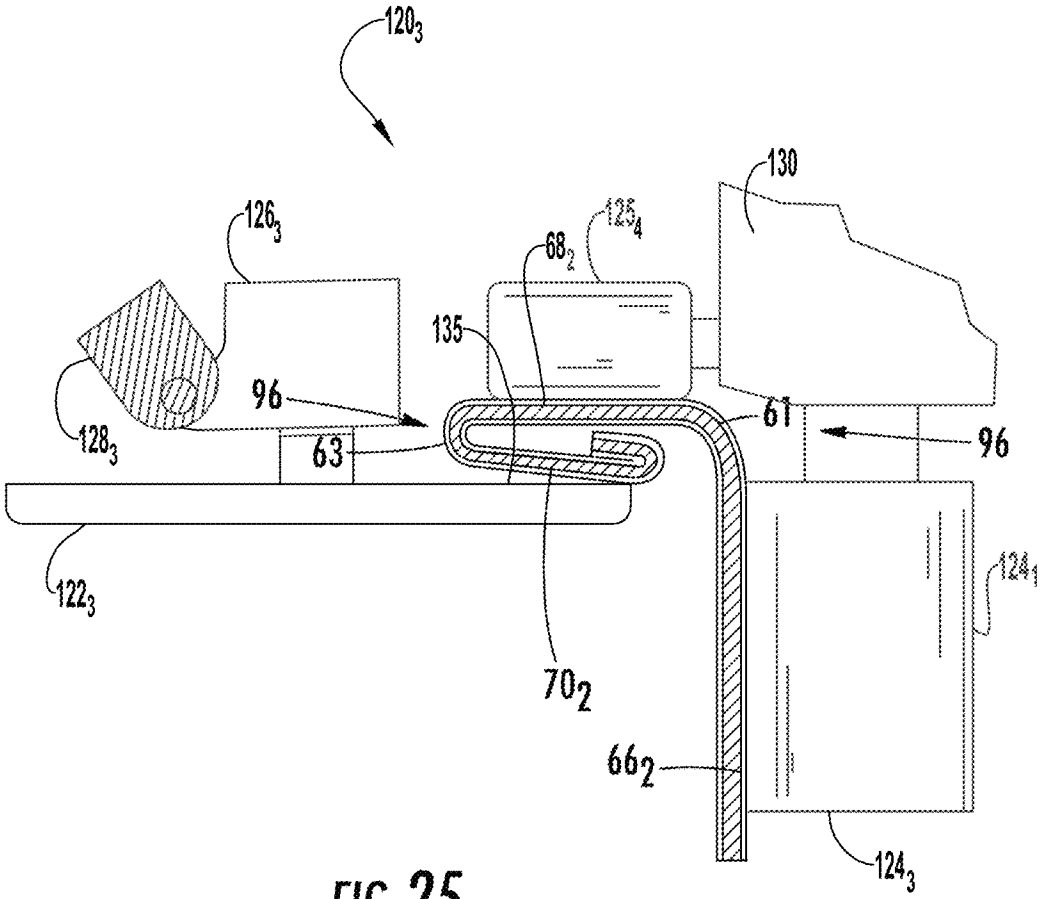
FIG. 25 is a side depiction of the third folding pass in the folding apparatus of FIG. 14.

FIG. 25 is a side depiction of the third folding pass $\mathbf{120}_3$, where again the only essential difference is the tooling configuration that finally folds the angled element $\mathbf{70}_2$ so that it is substantially parallel to the horizontal element $\mathbf{68}_2$. Horizontal backup dies $\mathbf{125}_3$, $\mathbf{125}_4$ support the horizontal element $\mathbf{68}_2$ during folding.

As in the first two folding passes $\mathbf{120}_1$, $\mathbf{120}_2$, instead of pinching the arcs 61, 63 tight, the folding die $\mathbf{122}_3$ is shaped to define a folding surface 135 that is sized and operably positioned to contact against only the straight angled element $\mathbf{70}_2$, not the arc 63 or the arc in the distal hook shaped end. The folding die $\mathbf{122}_3$ is minimally spaced from the opposing roller die $\mathbf{125}_4$ by a gap that is the same or greater than the radius of the arc 63, defining the material relief space 96 adjacent the arc 63. Likewise, the backup die $\mathbf{124}_3$ contacts only the element $\mathbf{66}_2$, not the arc 61, and is minimally spaced from the opposing roller die $\mathbf{125}_4$ to provide the material relief space 96 adjacent the arc 61. The material relief spaces 96 adjacent the arcs 61, 63 free them and the element $\mathbf{68}_2$ up to positionally shift during folding, as needed, to relieve stresses and strains.

Figure 26:
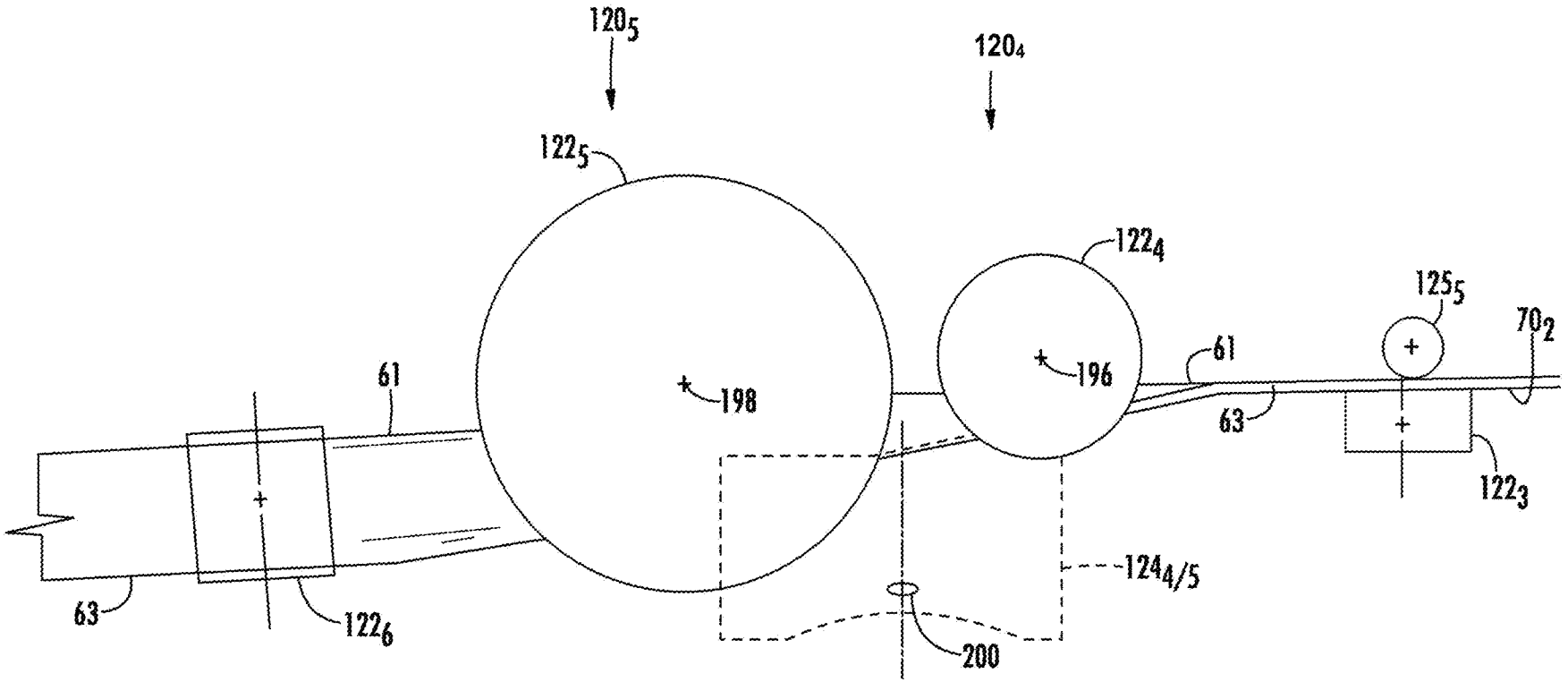
FIG. 26 is an elevation depiction of the fourth and fifth folding passes in the folding apparatus of FIG. 14.

FIG. 26 is an elevational depiction of the fourth and fifth folding passes $\mathbf{120}_4$, $\mathbf{120}_5$. These are the first two in the series of sequential folding passes that fold the horizontal element $\mathbf{68}_2$ downwardly toward the vertical element $\mathbf{66}_2$. In these illustrative embodiments, the folding dies $\mathbf{122}_4$, $\mathbf{122}_5$ are constructed of freewheeling (non-powered) tapered cam rollers. The folding dies $\mathbf{122}_4$, $\mathbf{122}_5$ have axes of rotation 196, 198 that straddle a centerline 200 of the vertical backup die $\mathbf{124}_{4/5}$, which they share.

Figure 27:
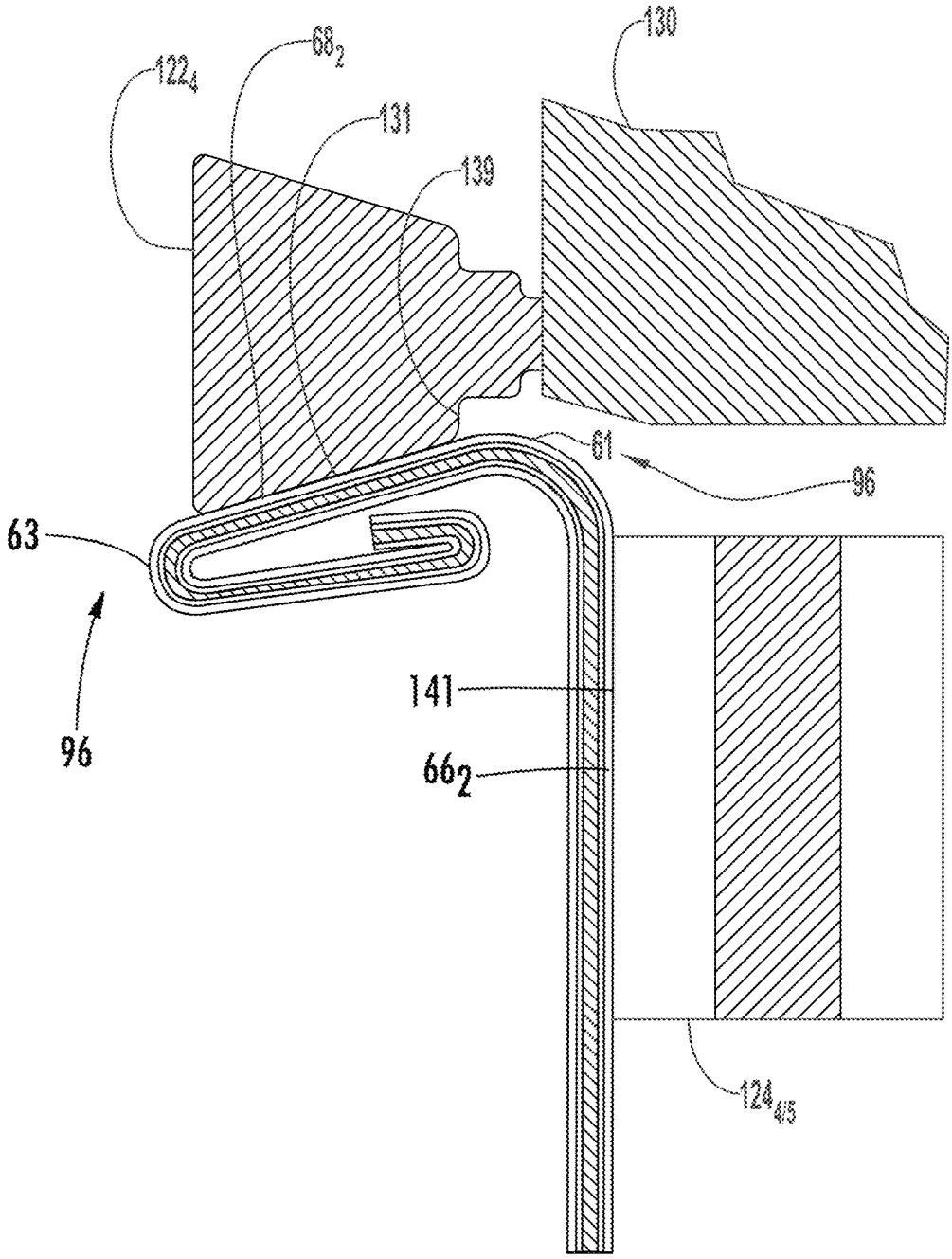
FIG. 27 is a side depiction of the fourth folding in the folding apparatus of FIG. 14.

FIG. 27 is a lateral cross-sectional depiction taken along the axis 196 of the fourth folding die $\mathbf{122}_4$ as depicted in FIG. 26. As above, instead of pinching the arc 61 tight, the folding die $\mathbf{122}_4$ is shaped to define a folding surface 137 that is sized and operably positioned to contact against only the straight horizontal element $\mathbf{68}_2$, not the arc 61 or the arc 63. The folding surface 137 terminates at a clearance surface 139 extending away from the horizontal element $\mathbf{68}_2$, and is minimally spaced from the backup die $\mathbf{124}_{4/5}$ by more than the radius of the arc 61, thus defining the material relief space 96 that is sized and positioned to clearingly disengage from the arc 61 and the element $\mathbf{68}_2$ during the folding process. Note that longitudinally offsetting the opposing roller dies $\mathbf{122}_4$, $\mathbf{124}_{4/5}$, as indicated by the respective cross-sectional hashings, significantly increases the size of the material relief space 96 between them.

Figure 28:
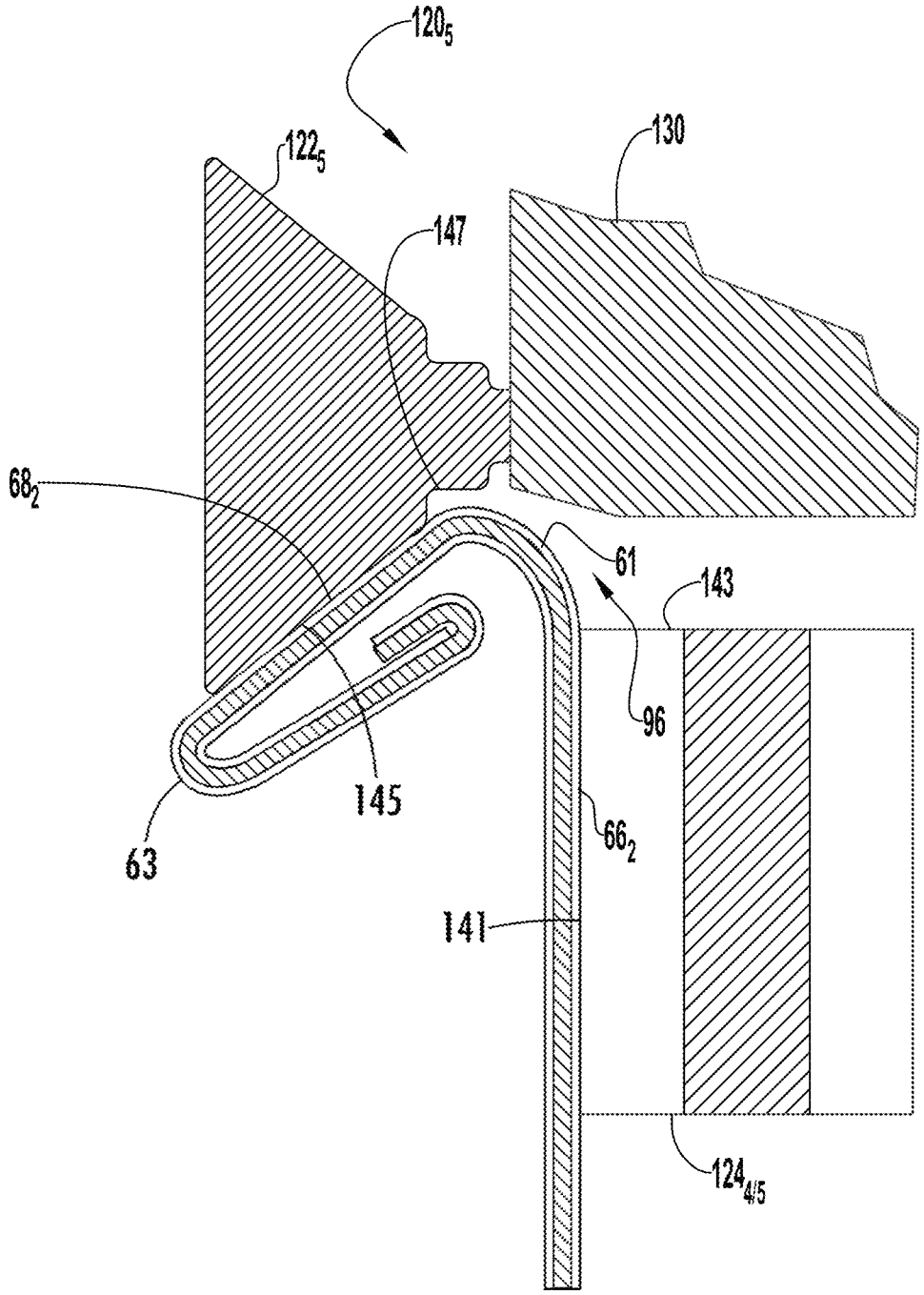
FIG. 28 is a side depiction of the fifth folding pass in the folding apparatus of FIG. 14.

FIG. 28 is a lateral cross-sectional depiction taken along the axis 198 of the fifth folding die $\mathbf{122}_5$ as depicted in FIG. 26. Similar to the fourth folding pass $\mathbf{120}_4$, the folding die $\mathbf{122}_5$ is shaped to define a folding surface 145 that is sized and operably positioned to contact against only the straight horizontal element $\mathbf{68}_2$, not the arc 61 or the arc 63. The folding surface 145 terminates at a clearance surface 147 extending away from the horizontal element $\mathbf{68}_2$, and minimally spaced from the backup die 124415 by a distance more than the radius of the arc 61, thereby defining the material relief space 96 that is sized and positioned to clearingly permit the arc 61 and the element $\mathbf{68}_2$ to positionally shift during the folding process.

Figure 29:
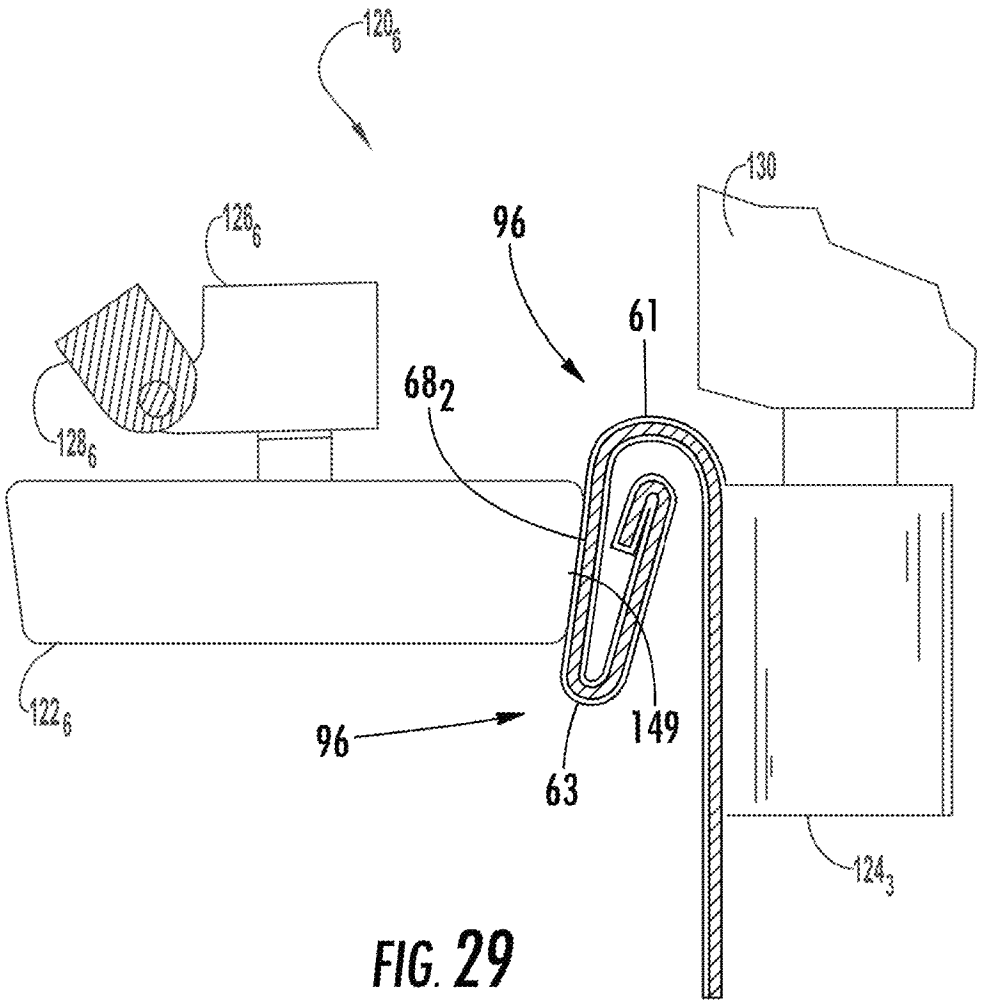
FIG. 29 is a side depiction of the sixth folding pass in the folding apparatus of FIG. 12.
Figure 30:
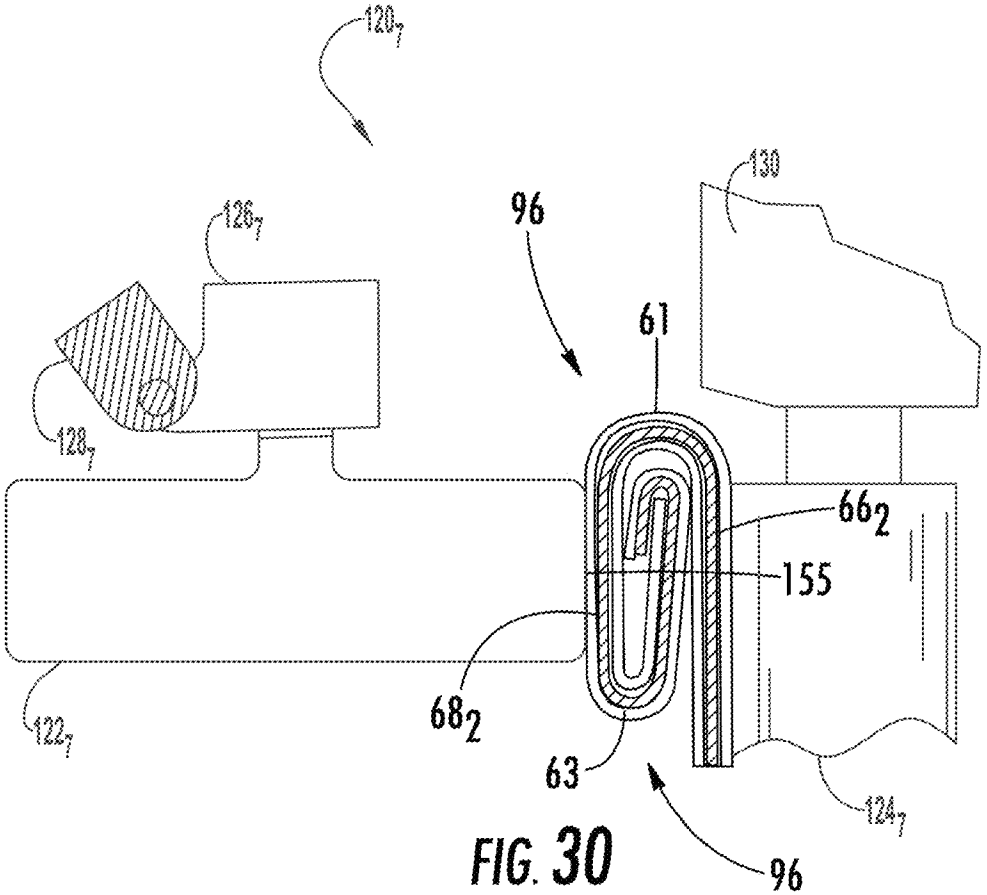
FIG. 30 is a side depiction of the seventh folding pass in the folding apparatus of FIG. 12.

FIG. 29 is a diagrammatic depiction of the sixth folding pass $\mathbf{120}_6$ in these illustrative embodiments. The folding die $\mathbf{122}_6$ is shaped to define a contact surface 149 that operably contacts only the horizontal element $\mathbf{68}_2$, with upper and lower clearance surfaces 151, 153, respectively, extending away from the horizontal element $\mathbf{68}_2$ to create the material relief spaces 96 into which the arcs 61, 63 and the element $\mathbf{68}_2$ can positionally shift during the folding process. FIG. 30 depicts the seventh and final folding pass $\mathbf{120}_7$ in these illustrative embodiments. Here, the folding die $\mathbf{122}_7$ makes the last fold placing the horizontal element $\mathbf{68}_2$ substantially parallel to the vertical element $\mathbf{66}_2$. That forms the standing seam 25 as a cumulative result of the folding passes $\mathbf{120}_1$-$\mathbf{120}_7$. This folding pass is like the preceding one, with the folding die $\mathbf{122}_7$ having a contact surface 155 that is sized and positioned to contact only the horizontal element $\mathbf{68}_2$, and with clearances creating the material relief spaces 96 adjacent both arcs 61, 63.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. A portable sheet metal folding apparatus that reshapes a sheet metal panel profile into a different predetermined shape, the profile having a first straight element joined to a non-parallel second straight element by a first arc forming an included angle between the straight elements, the apparatus comprising:

a first roller die set configured to fold the first and second straight elements toward each other reducing the included angle to a predetermined folded angle, the roller die set having a first roller die with a first roller surface configured to operably contact the first straight element at the folded angle and a second roller die having a second roller surface configured to operably contact the second straight element at the folded angle, and wherein:

the first roller surface defines a terminal end in operable contacting engagement against the first straight element nearest one end of the first straight element that is contiguous with the first arc, and the terminal end intersecting a clearance surface angled away from the first straight element and thereby creating a material relief space between the first and second roller surfaces providing spatial clearance for accommodating positional variations of the first arc to relieve stress and strain in the profile during the folding; and the second roller surface defines opposing terminal ends each in operable contacting engagement against the second straight element, each terminal end intersecting other clearance surfaces angled away from the second straight element and thereby creating respective material relief spaces both between the first and second roller surfaces and between the second roller surface and a third roller die contacting a third straight element of the profile that is connected to the second straight element by a second arc, the material relief spaces providing spatial clearances for accommodating positional variations of the first and second arcs to relieve stress and strain in the profile during the folding.

2. The apparatus of claim 1 further comprising a second roller die set configured to fold the second straight element and the third straight element of the profile toward each other to a second predetermined folded angle.

3. The apparatus of claim 2 comprising a first plurality of roller die sets including the first die set configured to progressively fold the first and second straight elements toward each other, and a second plurality of roller die sets including the second die set configured to progressively fold the second and third straight elements toward each other.

4. The apparatus of claim 2 wherein the first roller die set is configured to fold the first straight element upwardly and the second roller die set is configured to fold the second straight element downwardly.

5. The apparatus of claim 4 wherein the first and second roller die sets comprise folding roller dies, configured to angularly reposition a respective straight element while folding, and backup roller dies, configured to maintain a fixed angular position of a respective straight element while folding, and wherein one of the first and second roller die sets is configured with two offset folding roller dies sharing the same backup roller die.

6. The apparatus of claim 1 wherein the first roller die has a first axis of rotation along a first angle and the second roller die has a second axis of rotation along a second angle that is different than the first angle.

7. The apparatus of claim 6 wherein the first axis of rotation is substantially perpendicular to the second axis of rotation.

8. The apparatus of claim 6 wherein the first axis of rotation is substantially horizontal and the second axis of rotation is substantially vertical.

9. A portable sheet metal folding apparatus that reshapes a sheet metal panel profile into a different predetermined shape, the profile having non-parallel first and second straight elements joined together by an arc forming an included angle therebetween, the apparatus having a roller die set configured to fold the first straight element and the second straight element toward each other to a folded angle, reducing the included angle therebetween, the roller die set comprising:

two folding roller dies each having a folding roller die surface operably contacting the first straight element at different folded angles, the folding roller die surface defining a terminal end nearest the arc that is in operable contacting engagement against the first straight element, the terminal end intersecting a clearance surface extending away from the first straight element;

an offset backup roller die opposing both folding roller dies, configured to maintain a fixed angular position of the second straight element between the folding roller dies and thereby creating respective material relief spaces between the folding roller die surfaces and the offset backup roller die providing spatial clearance for accommodating positional variations of the arc to relieve stress and strain in the profile during the folding.

10. The apparatus of claim 9 further comprising a rake configured to close a hook-shaped element that is formed by the opposing end of the first straight element.

* * * * *